US010710620B2

(12) United States Patent
Potter et al.

(10) Patent No.: US 10,710,620 B2
(45) Date of Patent: Jul. 14, 2020

(54) SYSTEMS AND METHODS FOR INTERFACING A RAILROAD CENTRALIZED TRAFFIC CONTROL WAYSIDE AND A RAILROAD CENTRALIZED TRAFFIC CONTROL OFFICE USING INTEROPERABLE TRAIN CONTROL MESSAGING

(71) Applicant: Meteorcomm LLC, Renton, WA (US)

(72) Inventors: Tim Potter, Seattle, WA (US); Michael J. Neeson, Omaha, NE (US); Steve Brog, Seattle, WA (US); Jerry Specht, Overland Park, KS (US); Bruce Simon, Acworth, GA (US); William Mark Allen, Canton, MI (US); Thanongsak Himsoon, Kent, WA (US); Wipawee Siriwongpairat, Kent, WA (US)

(73) Assignee: Meteorcomm LLC, Renton, WA (US)

( * ) Notice: Subject to any disclaimer, the term of this patent is extended or adjusted under 35 U.S.C. 154(b) by 0 days.

(21) Appl. No.: 16/231,891

(22) Filed: Dec. 24, 2018

(65) Prior Publication Data

US 2019/0126961 A1 May 2, 2019

Related U.S. Application Data

(63) Continuation-in-part of application No. 14/558,959, filed on Dec. 3, 2014, now Pat. No. 10,160,466.

(60) Provisional application No. 61/934,120, filed on Jan. 31, 2014.

(51) Int. Cl.
*B61L 27/00* (2006.01)

(52) U.S. Cl.
CPC ..... *B61L 27/0005* (2013.01); *B61L 27/0011* (2013.01); *B61L 27/0038* (2013.01); *B61L 27/0077* (2013.01)

(58) Field of Classification Search
CPC ..... B61L 27/0005; B61L 27/0011; B61L 27/0027; B61L 27/0072
See application file for complete search history.

(56) References Cited

U.S. PATENT DOCUMENTS

| | | | | |
|---|---|---|---|---|
| 3,250,914 | A * | 5/1966 | Reich | B61L 3/22 246/122 R |
| 4,532,509 | A * | 7/1985 | Pulverenti | B61L 7/088 340/3.31 |
| 7,808,892 | B1 | 10/2010 | Babcock et al. | |
| 8,032,078 | B1 | 10/2011 | Donich et al. | |
| 8,340,056 | B2 | 12/2012 | Siriwongpairat et al. | |
| 8,374,291 | B1 * | 2/2013 | Himsoon | H04L 27/22 375/340 |
| 8,605,754 | B2 | 12/2013 | Siriwongpairat et al. | |
| 9,789,891 | B2 * | 10/2017 | Hatazaki | B61L 27/04 |
| 2008/0315044 | A1 * | 12/2008 | Stull | B61L 27/0005 246/5 |
| 2011/0075641 | A1 * | 3/2011 | Siriwongpairat | B61L 27/0005 370/337 |

(Continued)

*Primary Examiner* — Jason C Smith
(74) *Attorney, Agent, or Firm* — Hubbard Johnston, PLLC

(57) ABSTRACT

A method of exchanging application messages generated by an applications with a format specified by a predetermined protocol and then encapsulating the message with a railroad edge messaging protocol (EMP) header and a railroad Class D messaging transport header to form a packet for transmission across a railroad communications system.

25 Claims, 9 Drawing Sheets

(56) References Cited

U.S. PATENT DOCUMENTS

2014/0365160 A1* 12/2014 Steffen, II ..... B61L 27/0055
702/122
2015/0353110 A1* 12/2015 Kernwein ..... B61L 25/02
701/117

* cited by examiner

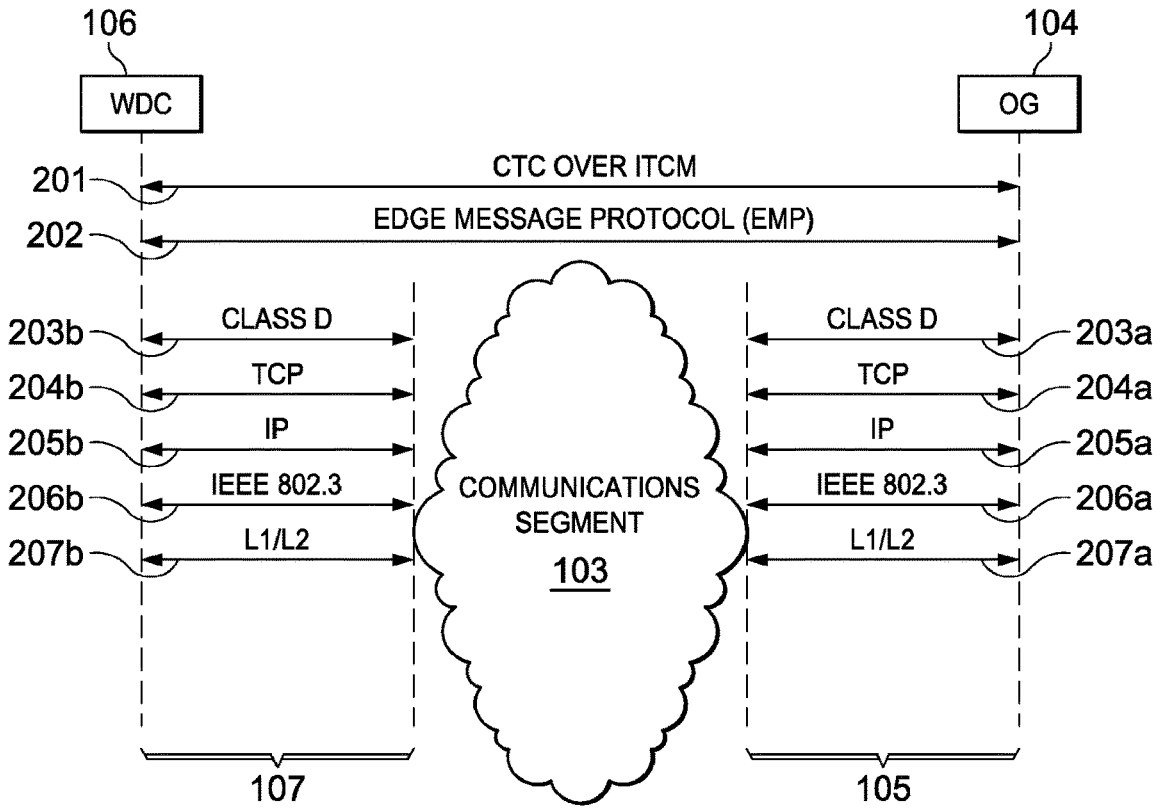
FIG. 2A
| L2/L1 HEADERS | IP HEADER | TCP HEADER | CLASS D HEADER | EMP HEADER | CTC MESSAGE | EMP FOOTER |
|---|---|---|---|---|---|---|
FIG. 2B
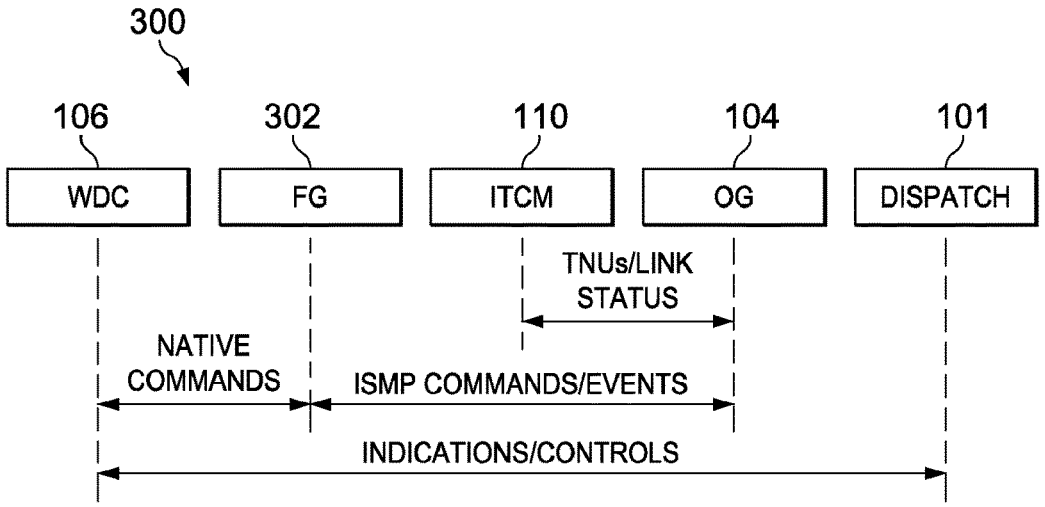
FIG. 3

SYSTEMS AND METHODS FOR INTERFACING A RAILROAD CENTRALIZED TRAFFIC CONTROL WAYSIDE AND A RAILROAD CENTRALIZED TRAFFIC CONTROL OFFICE USING INTEROPERABLE TRAIN CONTROL MESSAGING

CROSS-REFERENCE TO RELATED APPLICATION

The present application is a continuation-in-part of U.S. application Ser. No. 14/558,959, filed Dec. 3, 2014, and claims the benefit of U.S. Provisional Patent Application Ser. No. 61/934,120, filed Jan. 31, 2014, each of which is incorporated herein in their entirety for all purposes.

FIELD OF INVENTION

The present invention relates in general to railroad communications and control messaging.

BACKGROUND OF INVENTION

Centralized Traffic Control (CTC) is a well-known system in the railroad industry that allows a dispatcher at a central dispatch office to monitor and control interlockings and traffic flow within a designated territory. ("Interlockings" is generally a signaling arrangement that prevents conflicting train movements through junctions and crossings.) Among other things, a CTC system allows a dispatcher, in some circumstances, to directly control the signal indications giving train movement authorities for a block of track. In addition, at least in some circumstances, a dispatcher may directly control switches, for example, to allow a train to move to a passing siding, crossover to an adjacent track, or turnout to an alternate track or route. A CTC system may also ensure that appliances, such as switches, are properly set before and during a train movement through a track block. In addition to receiving status information from signals and switches, the CTC system may also collect status information from other "wayside devices" such as rail integrity/track circuits and hazard detectors.

Positive train control (PTC) systems help to prevent train-to-train collisions, over-speed derailments, incursions into established work zone limits, and the movement of a train through a switch left in the wrong position. A PTC system is "interoperable" if it allows locomotives of a host railroad and a tenant railroad to communicate with and respond to the PTC system while supporting uninterrupted movements over property boundaries. Interoperable PTC (IPTC) systems have been mandated for some railroads under the Rail Safety Improvement Act of 2008 (Public Law 110-432 of 2008.

In addition, the computerized Interoperable Train Control System Management (ITCSM) system allows for the configuration and management of system assets across the operating territories of different railroads.

SUMMARY

In order to efficiently use available resources, it would be advantageous to employ a system that allows different types of messages, including CTC, IPTC, and ITCSM messages, to be exchanged between communications nodes using at least some of the same underlying communications infrastructure.

Embodiments of the present principles allow for different types of railroad messages, such as Centralized Traffic Control (CTC), Interoperable Positive Train Control (IPTC) and Systems Management System (SMS) messages to be exchanged between a railroad dispatch office and remote assets, such as waysides, using the same communications segment. In particular, by encapsulating CTC messages in a message stack including the industry-standard EMP and Class D headers, control and signal indications information can be exchanged using the Interoperable Train Control Communications (ITCC) infrastructure and the Interoperable Train Control Messaging (ITCM) system, which also support IPTC and Interoperable Train Control System Management (ITCSM) system messaging applications.

An example of one embodiment of a method of exchanging messages in a railroad communication system includes generating a message having a format defined by a protocol with an application running on a sending one of a railroad wayside system and a railroad dispatch system. A railroad edge messaging protocol (EMP) header and a railroad Class D messaging transport header are appended to the message to generate a packet. The packet is transmitted to a receiving one of the railroad dispatch system and the railroad wayside system across the railroad communications system.

The method can be used to exchange messages for any application over a communications segment of a railroad communications system. More generally, a method for exchanging application-level data messages across a communications segment of a railroad communication system therefore comprises encapsulating a message that is generated by a computer application running with a railroad edge messaging protocol (EMP) header and a railroad Class D messaging transport header to form a packet, and then transmitting the packet across a communications segment of a railroad communications system. The method may be used, for example, to transport messages from different applications, over the same communications segment. Thus, the same railroad communication system segment or infrastructure is able to be used to send different types of railroad application messages.

Using the disclosed methods, current and future railroad communication system segments, infrastructures and systems are able to support not current application such as IPTC, Interoperable Train Control System Management (ITCSM) system, Distributed Power (DP), and other applications that communicate or exchange messages, but also messaging for future railroad applications.

BRIEF DESCRIPTION OF DRAWINGS

FIG. 2A is a more detailed logical diagram of the interface architecture between the wayside device Controller (WDC) and the Office Gateway (OG) shown in FIG. 1;

FIG. 2B is a diagram of a basic CTC message packet suitable for CTC messaging according to the principle of the present invention;

FIG. 3 illustrates a preferred set of Link/Transport State Options for communications between the WDC and DO;

DETAILED DESCRIPTION OF THE INVENTION

In the following description, like numbers designate like parts.

In the following description of the exemplary embodiments, the abbreviations and definitions provided in Table 1 of the Appendix will be used. In addition, the following specifications, publications, and standards are incorporated herein by reference for all purposes:

- AAR S-5800 Communications Systems Architecture (formerly ATCS Specification 200)
- AAR S-9354 Edge Message Protocol Specification.
- AAR S-9355 Class C Messaging Specification.
- AAR S-9356 Class D Messaging Specification.
- AAR S-9202 Wayside Interface Unit Requirements.
- AAR S-9553 Communications System Architecture.
- AAR Manual of Standards and Recommended Practices Section K-11 Railway Electronics Issue of 2005, Effective Mar. 1, 2005.
- Federal Information Processing Standards (FIPS) Publication 198 The Keyed-Hash Message Authentication Code (HMAC).
- National Institute of Standards and Technology (NIST) Publication 800-107, Recommendation for Applications Using Approved Hash Algorithms.

Figure 1A:
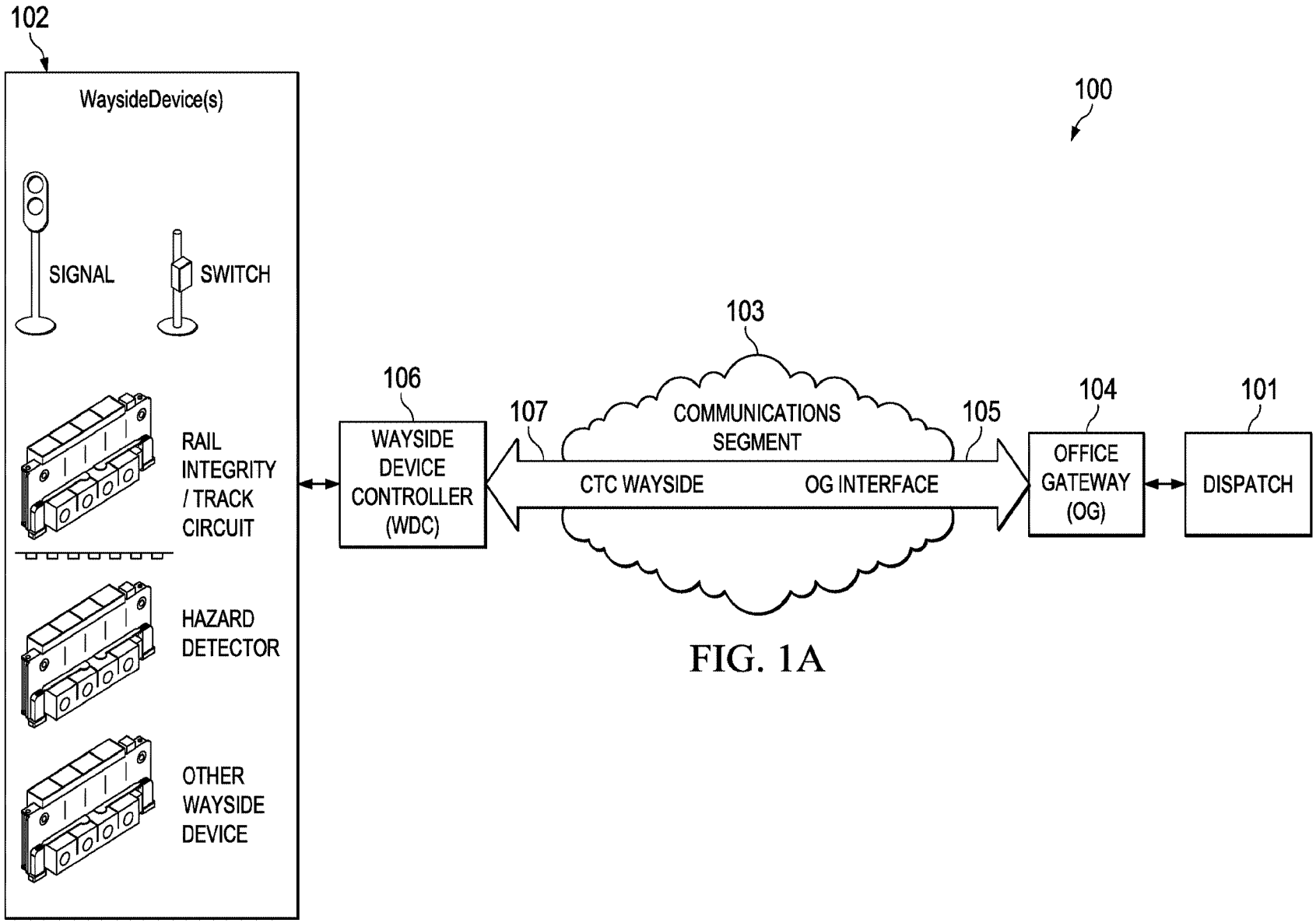
FIG. 1A is high-level functional block diagram of a representative Centralized Train Control (CTC) messaging system supporting the exchange of messages between a CTC) Wayside and a central Dispatch Office (DO) according to a representative embodiment of the principles of the present invention.
Figure 1B:
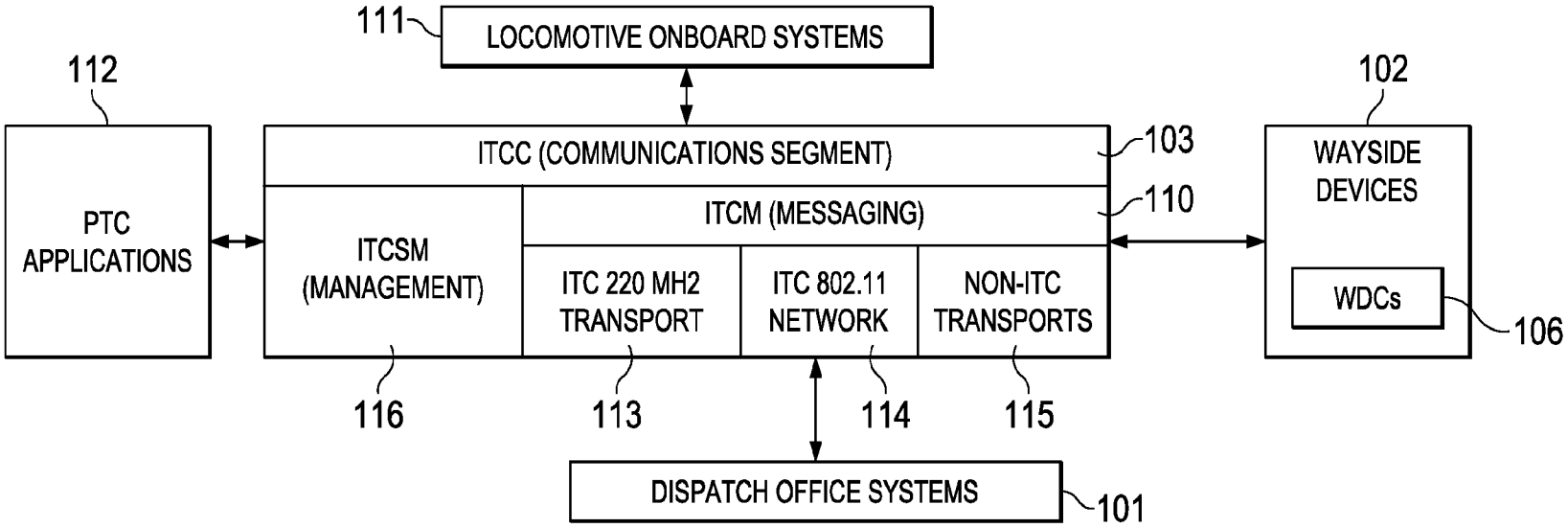
FIG. 1B is a high level diagram showing the Interoperable Train Control (ITC) system environment in which the CTC messaging system of FIG. 1A preferably operates.

FIG. 1A is a diagram of an example of a type of railroad communications system 100 in which Centralized Traffic Control (CTC) command and control messages are communicated between a central dispatch office (DO) 101 and a set of wayside devices 102 through one or more associated CTC wayside device controllers (WDCs) 106 and a communications segment 103. A non-limiting example of a communications segment is one that is based on the Interoperable Train Control Communications (ITCC) system and supports the Interoperable Train Control Messaging (ITCM) system 110 (FIG. 1B). An example of an ITCC transport system suitable for use as communications segment 103 is described in U.S. Pat. No. 8,340,056, which is incorporated herein for all purposes.

Communications segment 103 generally includes a network of hardwired connections, radio base stations, and wireless links. For example, DO 101 may communicate to a given WDC 106 through a hardwired communications network path or through a radio base station and a wireless link. Each WDC 106 may control single or multiple wayside devices 102 at a wayside, depending on the particular system configuration. A wayside interface unit (WIU) (see FIG. 13) collects signal status and switch position information. In a positive train control (PTC) system, WIU status messages are transmitted periodically by radio to update the locomotive PTC systems 111 (FIG. 1B) in the event of a change in status of a wayside device 102.

DO 101, which includes the host railroad's automated dispatch system (CAD) and back office (BO) (e.g., operator consoles, security keys, repositories), interfaces with communications segment 103 either directly or through an office gateway (OG) 104 and office gateway interface (a communications gateway) 105. WDC 106 interfaces either directly to communications segment 103 through CTC wayside interface (a communications gateway) 107 or through a field gateway (FG) 302 (FIG. 3). (FG 302 is provided in this example for interfacing legacy WDCs 106 and legacy wayside device controller protocols with communications segment 103.)

FIG. 1B shows the overall relationships between the high level components of a representative ITC system. Generally, ITCM system 110 provides a messaging interface to various applications, such as application programs ("applications") running on computers at the DO 101, applications running on systems 111 onboard the locomotives, PTC applications 112, and applications running on WDCs 102. Advantageously, ITCM system 110 allows these applications to communicate regardless of physical location and the type of connectivity (transport) used. Among other things, ITCM selects from between the available transports through communications segment 103, such as ITC 220 MHz wireless transport 113, ITC 802.11 network 114, and non-ITC transports 115, such as cellular and satellite communications. ITCM also controls message routing and manages Class D transports.

An Interoperable Train Control Systems Management (ITCSM) System 116 may also supported by communications segment 103. ITCSM System 116 is generally used to securely pass status, event, and configuration data between different railroad assets using ITCM messaging system. For example, the ITCSM architecture provides a secure method for railroad Back Office (BO) applications to remotely configure and manage each ITC asset, such as a wayside device 102*a*, to implement PTC functionality. ITCSM System 116 also supports the transfer and loading of software, security, data and configuration kits to remote assets, as well as the remote execution of commands by those assets.

In the ITCSM architecture, DO 101 communicates with remote assets, such as waysides 102, through an ITCSM gateway, the communications segment 103, and an ITCSM agent. The ITCSM agent serves as an asset proxy that is either linked into the remote asset executable (e.g., operates as an ITCSM Embedded Agent) or is connected over a direct Internet Protocol (IP) path to the remote asset (e.g., operates as an ITCSM Remote Agent). The ITCSM Agent handles security, pass commands, receives responses, reports events, and transfers files (kits/logs) to or from the asset. The ITCSM also provides the interface between ITCSM system and the asset, as well as handles parsing and translation of ISMP messages into the asset-specific API calls.

The ITCSM gateway also communicates with similar ITCSM gateways of other railroads via communications segment 103. In the preferred embodiment, any ITCSM communication between the host railroad BO and an asset is routed through the host railroad ITCSM gateway, which performs orchestration, role authorization, and other security services.

Figure 1C:
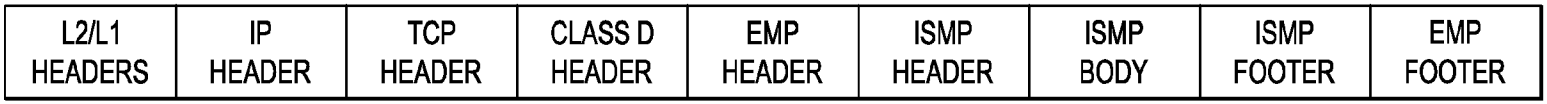
FIG. 1C is a diagram of a representative message packet structure preferably used for messaging in the ITC system environment of FIG. 1B.

For ITCSM and PTC applications, ITCM system 110 embeds an ISMP application message within an Edge Message Protocol (EMP) message envelope. The EMP message envelope is then embedded into a Class D transport packet for TCP/IP-based presentation to communications segment 103. The basic packet structure is shown in FIG. 1C. During normal operations, the Class D messaging header acts as the transport layer header for transmission over communications segment 103. However, for testing and as a failover mechanism to the ITCM system, messages can also directly sent, for example by ITCSM gateway the ITCSM agent, using TCP/IP.

OG interface 105 and CTC wayside interface 107 implement, among other things, connection managers, external link managers, and radio exchange processes that convert the messages received from OG 104 and WDCs 106 into the ITCC transmission protocol. (See U.S. Pat. No. 8,340,056).

System 100 exchanges CTC control signals (e.g., for changing switch positions and signal indications) and indications (e.g., information representing current signal indications) between WDC 106 and DO 101 using ITCM system 110 and the ITCC features of communications segment 103. In some circumstances, system 100 also uses particular assets of the ITCSM system for CTC messaging between DO 101 and wayside devices 102. In addition, system 100 may also use particular resources of the PTC system 112.

An alternate approach to the existing interfaces defining wayside device communications may provide for, among other things, any one or more of the following: (1) the support of ITCM-based transports of CTC messages from a given wayside device 102 through a BO to applications running at DO 101; (2) the integration with ITCC environment through the use of ITCM supported protocols, such as the Edge Messaging Protocol (EMP) in accordance with the AAR S-9354 specification and Class D messaging in accordance with the AAR S-9355 specification; (3) the reuse of the existing Advanced Train Control System (ATCS) message data payload where possible to reduce impacts on the creators and consumers of these messages; (4) the reduction of repetitive status checks message overhead; (5) the support for the authentication of critical messages by the wayside and office endpoints through the use of an EMP Hash Message Authentication Code (HMAC); (6) the support for management functions using the Interoperable Systems Management Protocol (SMP) standard; and (7) the support of TCP/IP-based transport of SMS messages between wayside devices 102 and applications running on DO 101.

FIG. 2A is a more detailed logic diagram showing the layered protocols supporting messaging between OG 104 and WDC 106 using the ITCM system. FIG. 2B illustrates the basic message packet structure. The upper layers use end-to-end application messages exchanged using the present CTC over ITCM protocol (Layer 201) and the Edge Message Protocol (EMP) format in accordance with the AAR Specification S-9354 cited above (Layer 202). The lower layers are based on conventional transport and network protocols by which the WDC 106 and OG 104 interact with communications segment 103. In the illustrated embodiment, the lower layers include Class D Layer 203, in accordance with AAR Specification S-9355 (cited above), Transmission Control Protocol (TCP) Layer 204, Internet Protocol v.4 (IP) Layer 205, IEEE 802.3 (Ethernet 10 Mbps/100 Mbps/1 Gbps) Transport Layer 206, and Data Link and Physical Layers (L1/L2) 207.

In the preferred embodiment, the physical cable and connector configurations are implementation specific and the IP Address and TCP port configuration is coordinated at time of installation. Class D Layer 203 preferably supports, at a minimum, the Protocol Layer of Class D in the Client role in accordance with AAR Specification S-9355 including all identified options with the exception of the Transport Layer Security (TLS) requirements, which are optional.

Figure 4:
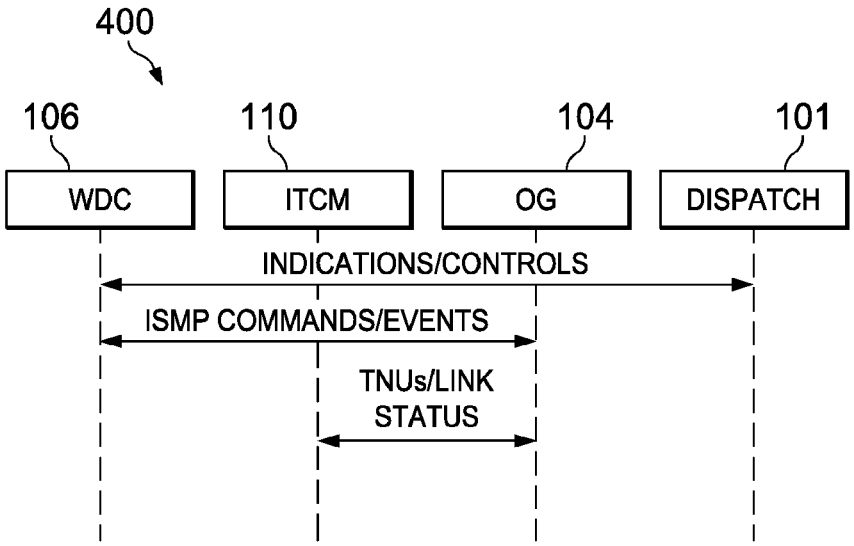
FIG. 4 illustrates a preferred set of Link/Transport State Options for communications between the WDC and DO in a system not employing the Field Gateway (FG) shown in FIG. 3.

FIGS. 3 and 4 show the various types of messages available for the determination of the state of the transport. FIG. 3 illustrates an embodiment including a Field Gateway (FG) 302 and FIG. 4 illustrates an embodiment without an FG. Implementation differences can expand the reach of some of these messages beyond WDC 106 and Dispatch 101, allowing them to move further to the endpoints in many, but not all cases.

Indications and controls are exchanged between Dispatch 101 and WDC 106 through OG 104, ITCM system 301, and when used, FG 302. ISMP commands and events are exchanged between OG 104 and WDC 106 through ITCM 301. When used, FG 302 translates the ISMP commands, indications, controls, and events into native commands suitable for WDC 106. TNUs and link status messages are exchanged between OG 104 and ITCM system 301. OG 104 translates indications, controls, ISM messages, and so on, into native messages and/or commands for processing by DO 101.

ITCM system 301 provides link/transport state information to communicating applications in several ways. For example, the primary mechanism for determining the status of connections between OG 104 and waysidewas 104 is to configure OG 104 or a separate application to capture a feed of the Transport Network Updates (TNUs) used internally in ITCM system 301 to build routing tables. These routing tables list all the transports available to all the waysides, and are refreshed regularly (depending on the ITCM system configuration, the refresh can take place every few seconds).

In addition, basic filtering by the communicating applications eliminates routes to areas outside the interest of CTC, for example the routes to the waysides of other railroads or the routes to locomotives. Alternately, an given application may implement more complex filtering. Given a captured data stream, an application can determine if a transport to the messaging server at a wayside 106 is available, although no indication of the connectivity to WDC 106 or FG 302 may be available.

ITCM System 301 also has a number of Systems Management System (SMS) events available to report on its internal state changes. For example, events are generated when applications connect or disconnect over Class D to ITCM. Events are also generated when connections are made or lost to the remotes (e.g., waysides 102). These events can be used to further refine the state of the applications using ITCM 301. WDC 106 (or FG 302) therefore support much of the ISMP, which allows that component to also generate SMS events to report on the state of its connectivity, further refining the state of WDC 106 and/or connected devices within the system.

In the preferred embodiment, messages exchanged between WDC 106 and OG 104 include EMP layer 202, with each message including the EMP header described in Table 2 and the immediately following discussion.

The value in the Data Integrity field, when application specific, is obtained by truncating to 32 bits a 160-bit value calculated using the SHA-1-160 Hash Message Authentication Code (HMAC) algorithm and the Operational Private Key assigned to the WIU. The calculation of the HMAC and its truncation are described in the FIPS Publication 198 and NIST Publication 800-107 [7] cited above and is preferably performed over the entire EMP header and payload. In alternate embodiments, a Cyclical Redundancy Check (CRC) is a configurable option for the Data Integrity field value for testing purposes and is also calculated over the entire EMP header and payload. In the preferred embodiment, the HMAC and CRC options are mutually exclusive, such that when the HMAC is used, the CRC option is not used, and vice versa.

ITCM System 301 does not guarantee that messages are delivered to the destination in the order in which they are sent by the source. It also does not guarantee that duplicates will never be created. Consequently, each end point in a CTC conversation must maintain a sequence number, which is inserted into the EMP Message Number field for determining the ordering of messages, as well as removal of duplicates. For backwards compatibility with existing CTC waysidewa device controllers and the ATCS protocol, this sequence number starts at 0 and increments to 127 before rolling over to start again. OG 104 maintains separate sequence numbers for each WDC 106.

In the preferred embodiment, the EMP Message Number field supports a 32-bit number, which advantageously allows for an increased range of Message Numbers while still supporting a backwards compatibility mode. OG 104 must therefore track each WDC 106 to determine whether it supports a 7 or 32 bit sequence number and to use the correct type of sequence number when communicating with that particular wayside. The sequence number is incremented for all messages, with the exception of Acknowledgments (Ack) or Negative Acknowledgments (Nack).

Preferably, the Message Number on an Ack/Nack is set to the same value as the Message Number of the request for which it was created. The Reset WDC Sequence Number message is available for OG 104 to request the WDC reset its sequence number to 0.

The Message Time is the time defined by the sender's application layer.

In the preferred embodiment, a wayside component (e.g., a WDC 106 or WIU) maintains clock synchronization with an accuracy of +/−1 second per one hour period when connected to one of two sources: (1) a Class C messaging source with a one second time resolution, assuming a 10 second Class C broadcast interval; or (2) a source using a time clock synchronization protocol in accordance with either the native IP Network Time Protocol (NTP), Version 3, as specified in the Internet Engineering Task Force (IETF) Request for Comment (RFC) 1305, or the Simple Network Time Protocol (SNTP), Version 4, as specified in IETI RFC 4330. In the illustrated embodiment, both options (1) and (2) are implemented, although the wayside component ensures that only one is enabled at a time via configuration options.

In the absence of time information, a given WDC 106 maintains its WDC clock time so that the drift from clock time does not exceed +/−2000 ms for at least an 8 hour period, although a duration greater than 8 hours may be specified for a particular WDC 102. Over the life of a WDC 106, once temperature and life are factored in, the clock drift shall not exceed +/−2000 ms for at least a 2 hour period.

For ISMP message addressing, the source and destination address fields preferably use lower case alphanumeric characters. (By convention all ITCM EMP addresses are lower case, since the ITCM protocol is case sensitive and different case EMP addresses resolve to different end points.)

Each WDC 106 is associated with a WDC Identifier for all ITC-compliant applications and is constructed (but not formatted) generally in accordance with AAR S-5800, cited above (Appendix T). The format in which the WDC Identifier is used and encoded into the EMP message header is described below. The WDC identifier is constructed in accordance with the following template, for ITC-compliant applications:

IRRRLLLGGGSS

Where:

I=ATCS Address Type Identifier;

RRR=ATCS Number assigned to owning organization;

LLL=Decimal numeric identifier assigned by owning organization;

GGG=Decimal numeric identifier assigned by owning organization;

SS=Decimal numeric identifier assigned by owning organization; and

LLLGGGSS is unique for any owning organization ATCS WDC identifier.

Each WDC 106 is associated with an EMP address, which is constructed and formatted in accordance with the grammar for wayside EMP addresses described in Appendix A to AAR S-9354. The preferred construction of the WDC EMP address is as follows:

(1) <wayside identifier> consists only of the LLLGGG portion of the WDC identifier described above;

(2)<messaging name> consists of the SS portion of the WDC identifier described above in ASCII decimal character format;

(3) ".wdc" (constant string) is appended to indicate this message is for the given WDC 106; and (4)<owning_organization>.w.LLLGGG:SS.wdc is the resulting WDC EMP address format.

FG 302 is used to connect a WDC 106 using legacy protocols by acting as a proxy with respect to ITCM System 301. An FG 302 therefore uses the same addressing conventions on behalf of the corresponding legacy WDC 104.

For addressing OG 104, the Host Dispatch System Identifier for all ITC-compliant applications is constructed (but not formatted) generally in accordance with AAR S-5800 cited above (Appendix T). The preferred construction of the ATCS Host Dispatch System Identifier is as follows:

IRRRNNRLLL

Where

I=ATCS Address Type Identifier (2 for ground based hosts);

RRR=ATCS AAR Number assigned to owning organization;

NN=Decimal numeric network node identifier assigned by owning organization;

R=Decimal numeric address range identifier assigned by owning organization; and

LLL=Decimal numeric codeline identifier assigned by owning organization.

EMP addresses to OG 104 are preferably constructed and formatted in accordance with the grammar for wayside EMP addresses described in Appendix A to AAR S-9354. When OG 104 is used to facilitate operation between Dispatch 101 and a WDC 106, the preferred construction of the OG EMP Address is:

(1)<messaging name> identifies the OG 104 (acting as a proxy for DO 101) as defined by the owning organization;

(2) "etc." concatenated with the "NNRLLL" portion of the ATCS host address described above, in ASCII decimal character; and (3)<owning_organization>.b:ctc.NNRLLL is the resulting OG EMP address.

Generally, in CTC messaging, each message is acknowledged by the receiving node and the requesting node is responsible for the retry of the request in the event if the requested node fails to reply. Table 3 illustrates the preferred message format of the application layer data exchanged between a WDC 106 and OG 104.

FIGS. 5-10 illustrate a preferred set of CTC over ITCM Messages using CTC over ITCM logical path 201 shown in FIG. 2. In FIGS. 5-10, DO 101, OG 104 and OG interface 105 are collectively shown as office interface 501 and WDC 106, CTC wayside interface 107 and FG 302 (if any) are collectively shown as wayside segment 502.

Figure 5:
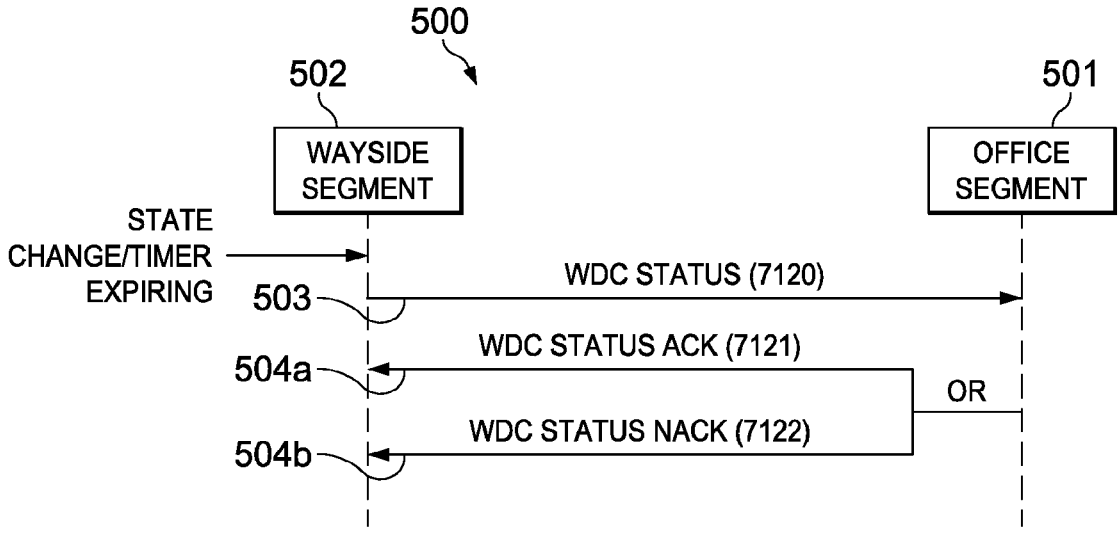
FIG. 5 illustrates a preferred messaging sequence for communicating an unsolicited WDC status message from the WDC to the DO.

FIG. 5 illustrates a scenario in which an Unsolicited WDC Status Message 503 is sent by a WDC 106 indicating the status of one or more wayside devices 102 monitored or controlled by the WDC 106. The Unsolicited WDC Status Message 503 is triggered, for example, by a change in the state of a monitored or controlled wayside device 102, the expiration of a configurable interval in the WDC

106, a requested reset of the sequence number for the WDC 106 to zero, or the receipt of a WDC Get Status message.

As shown in FIG. 5, after receiving and validating an Unsolicited WDC Status Message, OG 104 transmits a responsive WDC Status Ack Message 504*a* or WDC Status Nack Message 504*b* back to the initiating WDC 106. In the preferred embodiment, validation of a status message is any verification action or actions taken prior to an attempt by the receiving node to perform the requested action. The initiating WDC 106 will resend the WDC Status Message 503 a configurable number of times if it fails to receive an WDC Status Ack Message 504*a* or a WDC Status Nack Message 504*b* from OG 104 within a configurable timeout period. If a WDC Status Nack Message 504*b* is received, the initiating WDC 106 may resend the WDC Status Message 503 if the error code indicates the error condition is temporary.

The preferred message formats for the exchanges shown in FIG. 5 are shown in Tables 5-7. In particular, the EMP fields for the WDC Status Message (Message Type 7120) format is set out in Table 4. (In legacy WDCs, this message is an indication message). The WDC Status Message Body is set out in Table 5. Tables 6 and 7 show the EMP fields of the WDC Status Ack Message (Message Type 7121) and WDC Status Nack Message (Message Type 7122). The WDC Status Nack Message condition codes are provided in Table 8.

Figure 6:
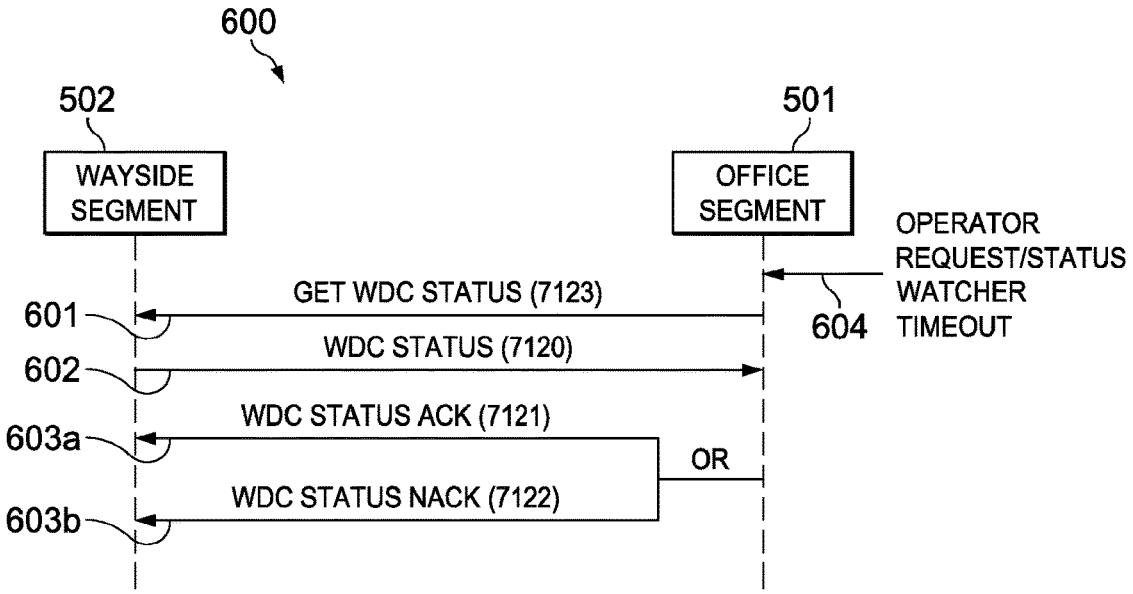
FIG. 6 illustrates a preferred messaging sequence for communicating a WDC status message from the WDC to the DO in response to a solicitation from the DO.

FIG. 6 illustrates an exemplary Get WDC Status scenario in which an operator triggers a request (Get WDC Status Message 601) through OG 104 for a given WDC 106 to send the status of one or more of the corresponding monitored and/or controlled wayside devices 102. In the illustrated embodiment, the response (WDC Status Message 602) from the requested WDC 102 is the same as the Unsolicited WDC Status Message discussed above with regards to FIG. 5. OG 104 in turn transmits an WDC Status Ack Message 603*a* or a WDC Status Nack Message 603*b* upon validation of the WDC Status Message received from the WDC 106. OG 106 will resend the Get WDC Status Message if it fails to receive a response from the WDC 106. Similarly, the WDC 106 will resend the WDC Status Message 602 a configurable number of times if it receives a WDC Status Nack Message 603*b* from OG 104 or fails to receive a WDC Status Ack Message 603*a* within a configurable timeout period.

A preferred format for the Get WDC Status Message (Message Type 7123), which does not include a payload field, is shown in Table 9. (In legacy systems, this messages is a recall message).

Figure 7:
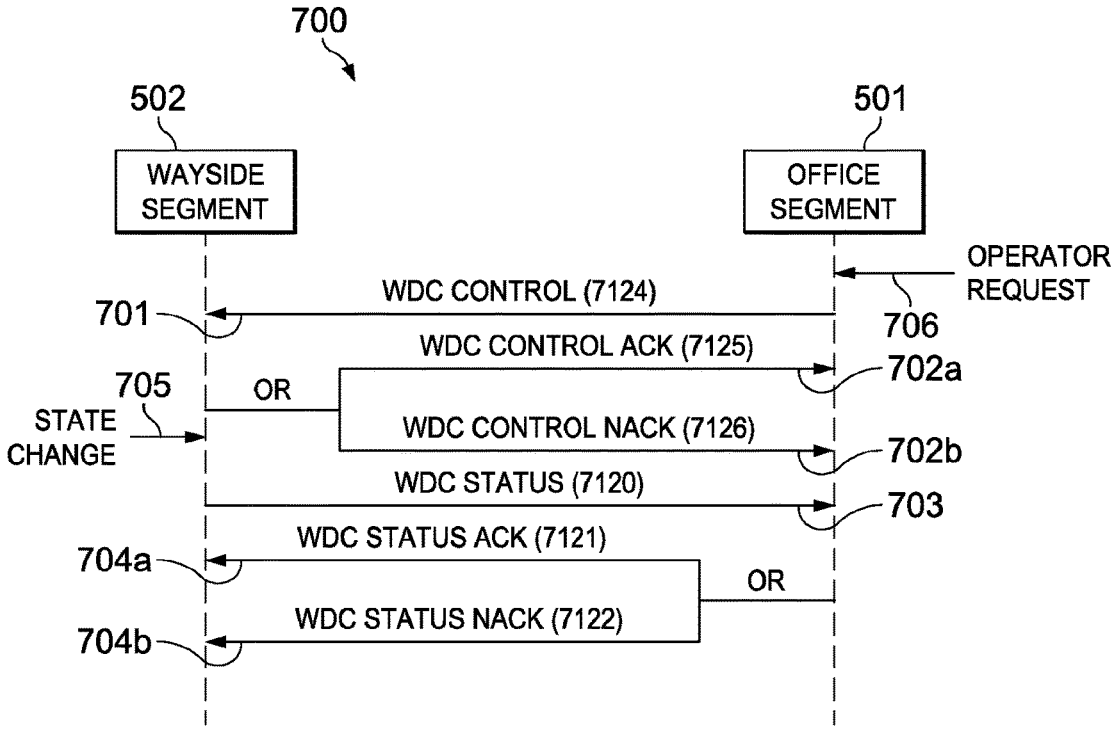
FIG. 7 illustrates a preferred messaging sequence for communicating control messages from the DO to the WDC and responsive status messages from the WDC to the DO.

A preferred WDC control message exchange is shown in FIG. 7.

Here, a request for a WDC 106 to change the state of one or more of the associated controlled wayside devices 102 is triggered by an Operator Request 706. In turn, OG 104 sends a request (WDC Control Message 701) to the WDC 106 to effectuate a change the state of the identified wayside device(s) 102 (State Change 705). The WDC Control Message 701 is acknowledged by the WDC 106, after validation and acceptance, with an WDC Control Ack Message 702*a* or, if the request cannot be successfully validated, a WDC Control Nack Message 702*b*. (For a control request, validation is any verification actions taken prior to actually attempting to perform the requested action, such as the execution of the WDC Control Message 701 by the receiving WDC 106 to effectuate the requested wayside device state changes.) OG 104 will send the WDC Control Message 701 a configurable number of times if it fails to receive a Control Ack Message 702*a* or a Control Nack Message 702*b* from WDC 106 within a configurable timeout period.

The successful processing of the control request and the change of the wayside device status by the WDC 106 may generate an Unsolicited WDC Status Message 703. OG 104 then returns a WDC Status Ack Message 704*a* or WDC Status Nack Message 704*b* upon validation of the WDC Status Message 703. The WDC 106 will resend the WDC Status Message 703 a configurable number of times if it receives a WDC Status Nack Message 704*b* or fails to receive a WDC Status Ack Message 704*a* within a configurable timeout period.

Table 10 shows the fields of the preferred format of the WDC Control Message (Message Type 7124), which is commonly used to set switch positions and clear/block signals. (In legacy systems, this message is a control request). The format of the body of the WDC Control Message is set out in Table 11. Tables 12 and 13 set out the preferred fields for the WDC Status Ack Message (Message Type 7125) and WDC Status Nack Message (Message Type 7126). The condition codes for the WDC Status Ack Message are described in Table 14.

Figure 8:
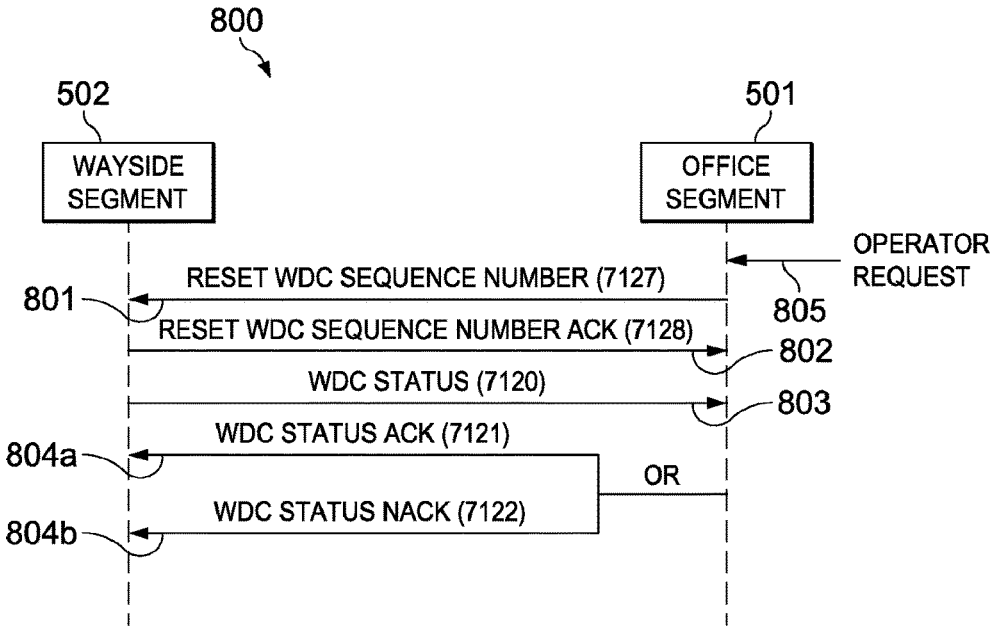
FIG. 8 illustrates a preferred messaging sequence for the DO to reset the WDC sequence number.

A preferred WDC sequence number reset message exchange is shown in FIG. 8. A request for a WDC to reset its sequence number to zero (Reset WDC Sequence Number Message 801) is triggered by OB 104 in response to an Operator Request 805, which is generated directly by an operator or by automated logic within OG 104. The WDC 106 acknowledges the reset request when received (Reset WDC Sequence Number Ack 802). OG 104 will send the Reset WDC Sequence Number Message 801 a configurable number of times if it fails to receive the acknowledgement within a configurable timeout period.

The WDC 106 resets the sequence number after which messages from the WDC 106 start with the new sequence number. After the WDC 106 resets the sequence number, it generates a standard WDC Status Message 803 for delivery to OG 104. OG 104 sends a WDC Status Ack Message 804*a* or a WDC Status Nack Message 804*b* upon validation of the Reset WDC Sequence Number Ack Message 802. The WDC 106 will resend the WDC Status Message 803 a configurable number of times if it receives a WDC Status Nack Message 804*b* or fails to receive the WDC Status Ack Message 804*a* within a configurable timeout period.

If OG 104 receives the Reset Sequence Number Ack Message 802, but fails to receive a new WDC Status Message 803, it may consider the sequence number to be reset and optionally send a Get WDC Status Message (discussed above) in order to confirm the sequence number. If OG 104 does not receive the Reset Sequence Number Ack Message 802, but does receive a WDC Status Message 803 with the correct sequence number, it may consider the sequence number to be reset and no further action is required. If the Reset Sequence Number Ack Message 802 later arrives after the WDC Status Message 803, the Reset Sequence Number Ack Message 802 may be discarded.

The preferred format of the Reset WDC Sequence Number Message 801 (Message Type 7127) is set out in Table 15 and the preferred format for the Reset WDC Sequence Number Ack Message 802 (Message Type 7128) is set out in Table 16.

In the ISMP system design, the Systems Management Gateway (SMG) preferably receives and responds to messages from a single Back Office address from Dispatch 101. The present CTC take advantage of SMS by this management infrastructure by integrating CTC messaging with the SMS system as shown in FIG. 9.

Figure 9:
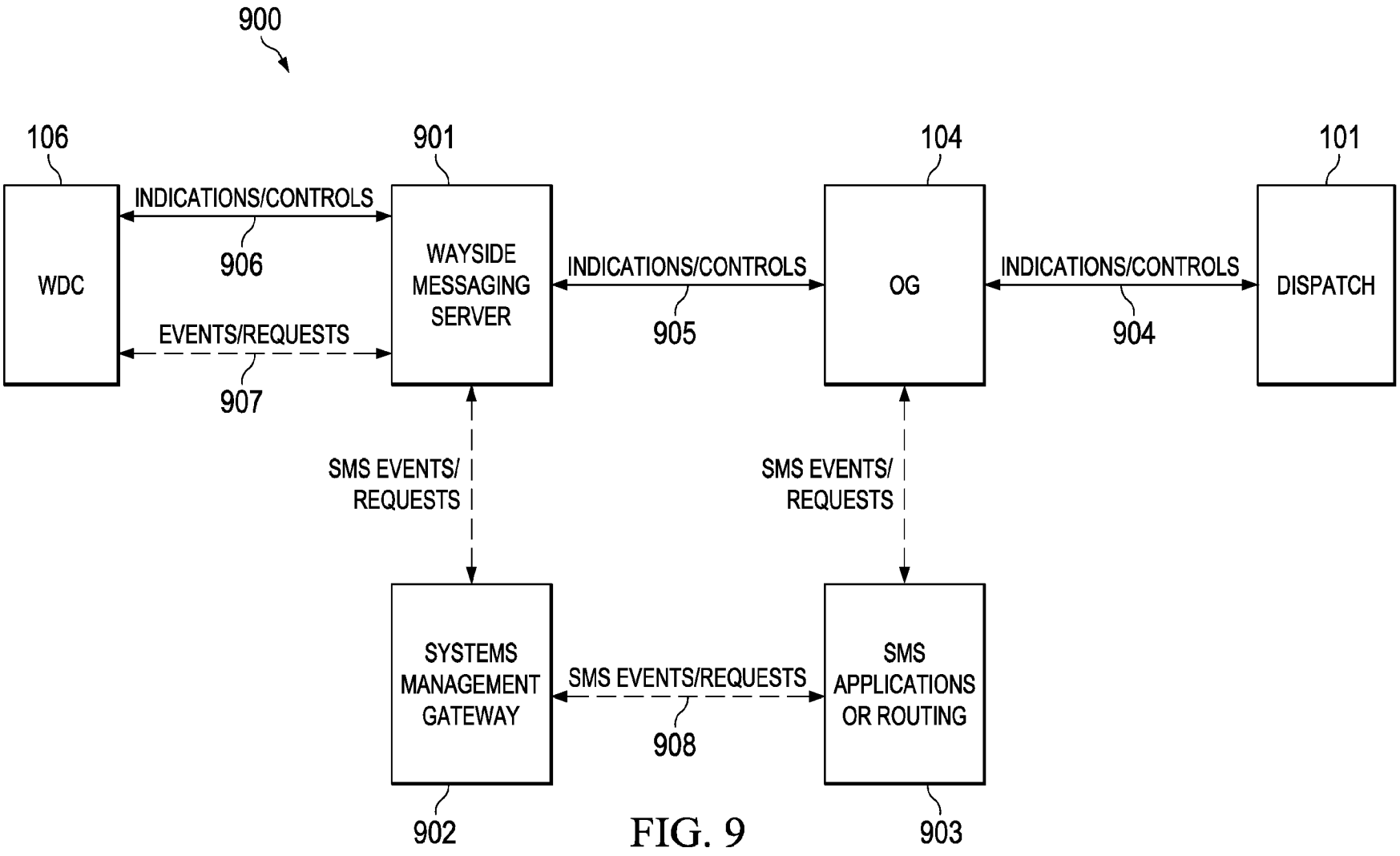
FIG. 9 illustrates a preferred message flow for messaging within the system shown in FIG. 1 in accordance with the Interoperable Systems Management Protocol (ISMP)

FIG. 9 illustrates a preferred ISMP message flow. In system 100, each WDC 106 and FG 302 (or alternatively a separately integrated SMS Agent) implements SMS (Systems Management System) functionality. The ISMP system only defines a particular messaging protocol, allowing the management capabilities of different assets (e.g. a WDC 106) to be implemented in different ways. For example, the management capabilities could be built into a WDC 106 itself or could implemented through a separate agent at the wayside.

In the message flow of FIG. 6, DO 101 exchanges indications and controls 904-906 with WDC 106 through OG 104 and wayside messaging server 901. In addition, OG 104 exchanges SMS Events and Requests 907-908 through SMS Applications or Routing 902 with WDC 106 through ITCSM Systems Management Gateway (SMG) 902.

Figure 10:
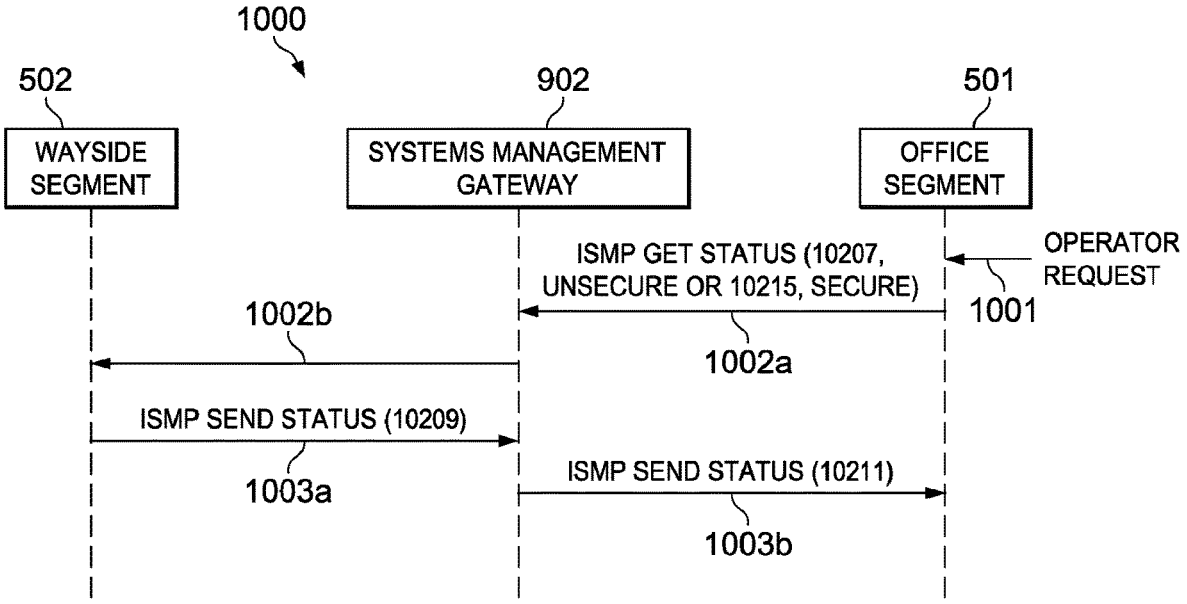
FIG. 10 illustrates a preferred messaging sequence for communicating ISMP status messages from the WDC to the DO in response to a solicitation from the DO.

An exemplary ISMP Solicited Status Message exchange using the system of FIG. 9 is shown in FIG. 10. A Get Status Message 1002 (Message Type 10207, if unsecure or 10215, if secure) is generated in response to an Operator Request 1101 from Dispatch 101 requesting that a given WDC 106 send its internal status conditions. The target WDC 106 returns the ISMP Send Status Message 1003 (Message Type 10209 between wayside Segment 502 and SMG 902, and 10211 between SMG 902 and Office Segment 501). OG 104 will resend the Get Status Message 1002 a configurable number of times if it does not receive the ISMP Send Status Message 1003 within a configurable timeout period.

Figure 11:
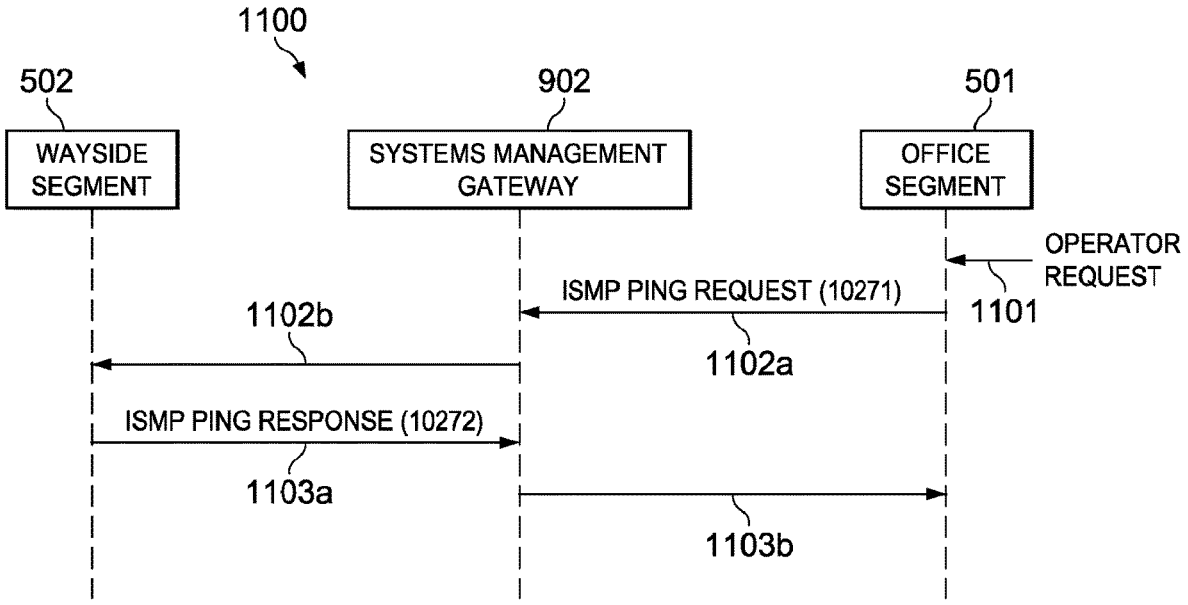
FIG. 11 illustrates a preferred messaging sequence for communicating an ISMP ping request from the DO to the WDC and a corresponding ISMP ping response from the WDC to the DO.

FIG. 11 illustrates a preferred ISMP Ping message exchange. An ISMP Ping Request Message 1102 (Message Type 10271) is generated in response to an Operator Request 1101 for determining if a wayside device 102 is operating and connected to communications segment 103. The corresponding WDC 106 responds to the ping with a ISMP Ping Response Message 1103 (Message Type 10272).

(Preferably, the ITCM system also supports a trace route message that allows a user to internally trace the delivery of messages through the ITCM components. This feature can be used, for example, to test delivery of messages to any EMP address without impacting the destination application.)

Figure 12:
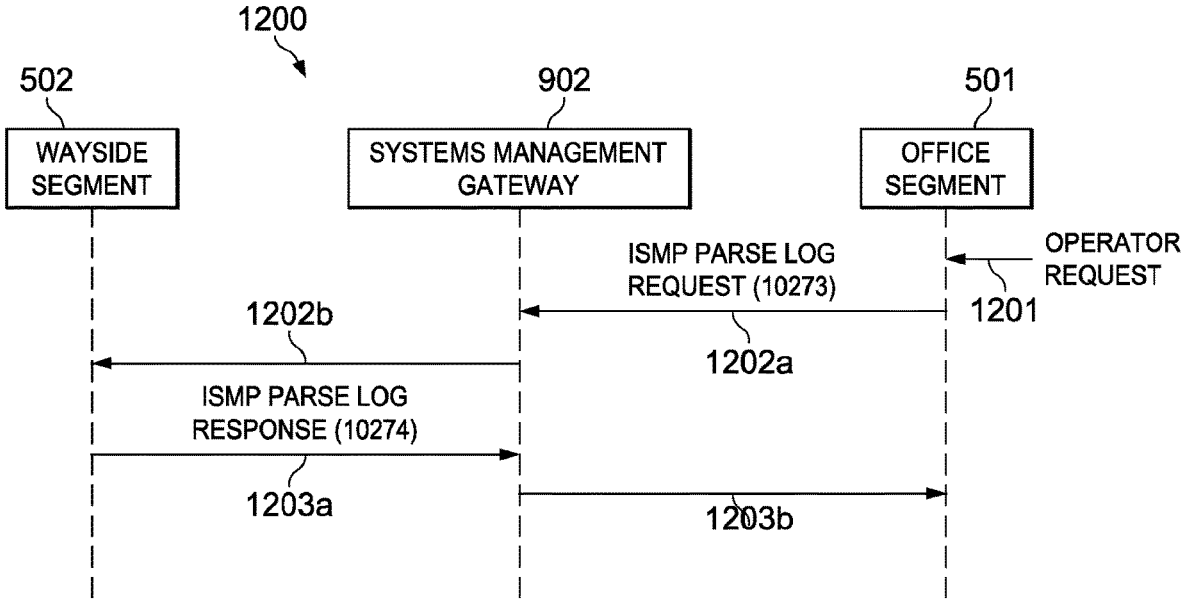
FIG. 12 illustrates a preferred messaging sequence for communicating an ISMP parse log request from the DO to the WDC and a corresponding ISMP parse log response from the WDC to the DO.

A preferred ISMP Retrieve Log exchange is shown in FIG. 12, which is used by an operator to access internal logs from a given WDC 106. In response to a Operator Request 1201, OG 104 generates an ISMP Parse Log Request 1202 (Message Type 10273) to the given WDC 106 to retrieve all or parts of an internal log based on a time interval or error levels. The WDC 106 returns the log data with ISMP Parse Log Response Message 1203 (Message Type 102734. OG 104 will resend the an ISMP Parse Log Request 1202 a configurable number of times if it does not receive the response from the WDC 106 within a configurable timeout period.

In the preferred embodiment, each WDC 106 implements a number of features for ISMP security, which allows assets to be provisioned securely and to receive new Operational Private Keys (OPKs), as needed. The ISMP security features, at a minimum, require that each WDC 106: (1) be a securable asset; (2) support a One Time User Password (OTUP), if deployed in a factory reset state; (3) accept security kits; and (4) accept OPK kits. To meet these requirements, System 100 implements a number of messages to support the management of the various keys from their delivery, to staging, to production usage.

In the preferred embodiment of System 100, the sending application layer uses the EMP layer settings and values identified in their respective message details. Table 17 summarizes some of the key header field values for all the CTC messages.

Generally, the PTC application has the highest priority (7) for the four key messages used to deliver PTC wayside status messages to a locomotive. As long as the train is operating in the PTC territory, if the wayside status is not continuously received by the locomotive within 18 seconds, the train will be put into restricted operation, which is very likely to delay train operations. The remainder of the PTC messages are allocated priorities between 4 and 6 so as to have a high priority, but not interfere with the wayside status related messages. CTC messages, although much lower in frequency, are also very high priority and can effectively stop all trains along a section of track if they are not delivered successfully (without the restricted operation option sometimes available to PTC applications). Therefore, the default priority for CTC messages is set to 6. (Preferably, the fields shown in Table 17 are configurable and the indicated values are the preferred default values).

In the preferred embodiment of System 100, WDC Status Messages deliver CTC data to a BO using CTC over ITCM System. In an alternate embodiment, CTC data are instead delivered using the Will Status Message used in the PTC messaging protocol. In particular, the additional CTC data is added to the PTC WIU Status Message and delivered through the existing communications channels. Where used, this approach eliminates the generation of a WDC Status message when the state of the system changes in favor of an unsolicited, periodic WIU Status Message containing the same information.

In the event that the additional CTC information is unavailable or uncertain, the entire CTC data is preferably not be included in the WIU Status Message and the size of the message reduced accordingly. (There is no appropriate binary value available for the message to indicate a field has no value.) Enhancing the WIU Status Message may also reduce or eliminate the use of the Get WDC Status message as well; however, this message could still be provided as a backup depending on the needs of the dispatching system.

Figure 13:
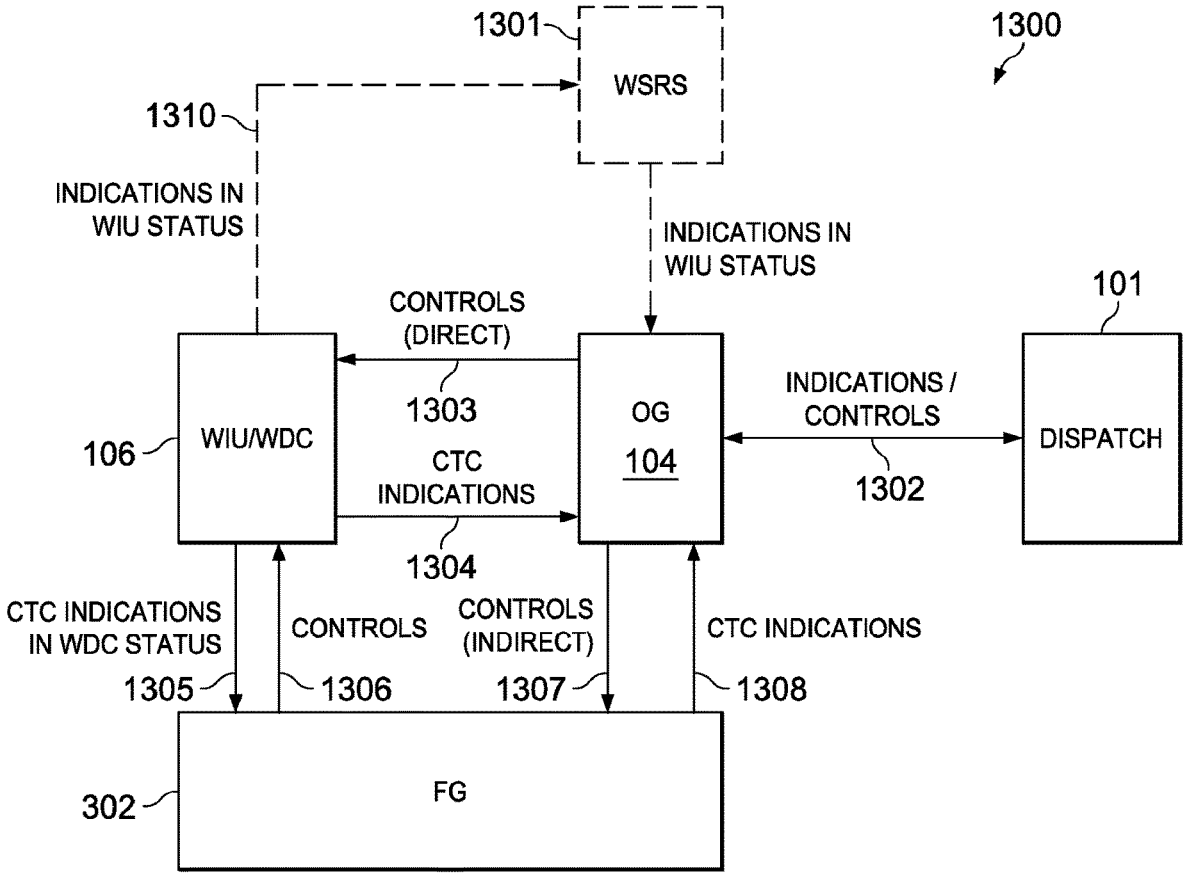
FIG. 13 illustrates a preferred message flow for sending indications from the DO to the WDC using wayside interface Unit (WIU) status messages.

FIG. 13 illustrates an exchange of WDC status indications using WIU Status Messages. This approach does impose some additional work on the back office, as the PTC messages are delivered to a Wayside Status Relay Service (WSRS) application 1301. More particularly, WIU Status Messages from WDCs 106 or the WIUs must be forwarded from WSRS 1301 application to OG 104 for processing where they could be joined with the stream of CTC data destined for the dispatching system. In one embodiment, this process is implemented as a static subscription from OG 104 to WSRS 1301.

In the exchanges shown in FIG. 13, indications and controls 1302 are exchanged between Dispatch 101 and OG 104. OG 104 then directly exchanges Direct Controls 1303 and CTC Indications with WDC (WIU) 106. When a FG 302 is used, WDC (WIU) 106 receives controls 1306 and transmits CTC Indications in WDC Status Messages through FG 302. Similarly, Dispatch transmits indirect controls 1307 and receives CTC indications through FG 302. WDC (WIU) 106 may also transmit indications as WIU Status Messages through WSRS 1301 and OG 104.

In the process shown in FIG. 13, OG 104 accesses all of the WIU Status Message keys to validate the EMP data integrity field and ensure that the message is valid before using the data contained in the message. Furthermore, the process of FIG. 13 is preferably a supported as an alternative to the WDC Status Messaging approach discussed in detail above. In other words, both approaches are preferably supported with a configurable indication of which approach is being used at a particular wayside location. Consequently, OG 104 must have access to information, for each WDC 106, which identifies approach by the given WDC 106.

This process of FIG. 13 may also impact the other users of the PTC Wayside Status message, since these messages are routed by WSRS 1301 in the back office and consumed by the TMC on the locomotive. Additionally, with this approach, it also may be necessary to ensure that the given WDC 106 is setup for constant beaconing rather than intermittent beaconing to ensure that the WDC indications are continuously sent to the back office for updating.

Table 18 illustrates a preferred WIU Status Message Body format for implementing the process shown in FIG. 13. The WDC indications that are not already represented in the WIU Status Message are added into the body of the WIU Status Message at the end of the Device Status field. This will have no effect on the WIU Status Message—EMP header.

In some embodiments of System 100, a separate WDC 106 may create indications to be delivered to a WIU for inclusion in the WIU Status messages. In these embodiments, the preferred implementation uses the WDC Status Message discussed above.

Table 19 provides a preferred set of ISMP Data Dictionary Variables used by WDC 106 in the ISMP Get Status and Send Status messages. Table 20 provides a preferred set of WDC/FG Specific Data Dictionary Variables. The Variable IDs specified in Tables 19 and 20 are integers.

As in any complex system, a failure of a component or communications link can always occur. In System 100, a failure can occur at various points in the message flow between a WDC 106 and Dispatch 101. Tables 20 and 21 identify some of the main components or linkages where a failure may occur.

In particular, Table 20 identifies particular WDC Failures, WDC-FG Link Failures, WDC-ITCM Link Failures (where no FG is used), and WDC-WIU Link Failures (where WIU Status is used). Table 20 illustrates scenarios including a failure of WDC 106 components, as well as scenarios in which a WDC 106 is unable to communicate with other components of System 100.

Table 21 identifies scenarios including a failure of a FG 302 component, as well as scenarios where ITCC experiences a failure resulting in a complete loss of communications between a FG 302 and OG 104. An ITCC failure could be due to a failure of ITCM, or the failure of all transports in the communications path (e.g., a radio, cell/base station, and so on) between the FG 302 and OG 104. In a configuration where the WDC status is combined with a PTC Status and delivered through ITCC, the failure of ITCC or the WSRS components would result in the same state, the loss of regular status messages to OG 104.

In the event of an OG 104 failure or the failure of the link to OG 104, all messages initiated from Dispatch 101 cannot be delivered and will timeout. Consequently, Dispatch 101 must take appropriate action to notify and remedy the failure. Similarly, messages from the field will not be delivered to OG 104 in the event of the OG failure and will time out in the component that issued them. The given component will then attempt a retry of the messages a configurable number of times if appropriate. Finally, messages from the field can be delivered to the OG in the case of a failure in the link between OG 104 and the Dispatch 101. Those messages requiring a response will be responded to normally with appropriate error codes in the Nacks.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims. It is therefore contemplated that the claims will cover any such modifications or embodiments that fall within the true scope of the invention.

TABLE 1

| Acronyms | |
|---|---|
| Acronym | Description |
| Ack | Acknowledgement message which acknowledges the successful receipt or processing (as specified) of a prior message. |
| ATCS | Advanced Train Control System. |

TABLE 1-continued

| Acronyms | |
|---|---|
| Acronym | Description |
| CAD | Computer Aided Dispatch. |
| CTC | Centralized Traffic Control. |
| Control | Variable length, bit mapped command for controlling the device configuration of a (wayside) Control Point |
| CP | Control Point (wayside) |
| CRC | Cyclic Redundancy Check |
| EMP | Edge Message Protocol. |
| FG | CTC Field Gateway. A software component assuming responsibility for the use of this specification at the Wayside. This component translates the protocol into appropriate WDC specific commands using pre-existing WDC protocols. |
| HMAC | Hash Message Authentication Code. |
| Indication | Variable length, bit mapped number for indicating the status and/or configuration of devices of a (wayside) Control Point. |
| ISMP | Interoperable Systems Management Protocol. The Protocol used by ITCSM for Systems Management communications. |
| ITCC | Interoperable Train Control Communications system. The communication system supporting PTC and other train operations applications. This includes ITCM, the 220 Radio transport, Cell transport, Wired transport, WiFi transport, and ITCSM. |
| ITCM | Interoperable Train Control Messaging. The messaging system used for communication of PTC and other train operations application messages. |
| ITCSM | Interoperable Train Control Systems Management. The systems management framework that makes use of ITCM. |
| Nack | Negative Acknowledgement message which acknowledges the failure of delivery or processing (as specified) of a prior message. A Nack will generally contain an error code specifying the type of error. |
| OG | CTC Office Gateway. A generic term for the Back Office component implementing the office side of this specification and potentially providing an abstraction layer between the CAD and the field. If separate from CAD, this component would convert between this specification on one side and the appropriate CAD protocol on the other side. |
| OPK | Operational Private Keys. Keys used by assets to create the EMP HMAC. |
| OTUP | One Time User Password. An ITCSM feature used when initializing a remote asset. |
| PTC | Positive Train Control. The first application making use of the ITC Communication System (ITCC). |
| Sequence Number | A serial number maintained by the users of this protocol in order to facilitate acknowledgments as well as message ordering. This is passed between these users through the Message Number in the EMP header. |
| SMG | Systems Management Gateway. A back office ITCSM component responsible for the coordination of ISMP requests between a railroads back office system and between a railroad back office and that railroad's managed assets. |
| SMS | Systems Management System. Synonym for ITCSM. |
| TTL | Time to Live. |
| UTC | Universal Coordinated Time. |
| Wayside | A physical trackside location with one to many WDCs. The Wayside may also include a Field Gateway. |
| WDC | Wayside device Controller. A trackside device responsible for controlling physical equipment. Also known as Logic Controller or Logic Unit. |
| WSRS | Wayside Status Relay Service. A service created and operated by each railroad that receives copies of all WIUStatus Messages (a PTC message containing wayside switch position and signal indication data) and relays them for re-broadcast through base |

TABLE 2

| Edge Message Protocol (EMP) Header Configuration | |
|---|---|
| EMP Field | Configuration |
| Protocol (header) version | Per AAR S-9354 Edge Message Protocol Specification |
| Message Type (ID) | As specified in each message definition |
| Message Version | 0 (zero), unless otherwise specified in message definition |
| Flags - Timestamp Format | Absolute Time |
| Flags - Encryption | No Encryption |
| Flags - Compression | No Compression |
| Flags - Data Integrity | See below |
| Data Length | Per AAR S-9354 Edge Message Protocol Specification. |
| Message Number | EMP Message Number field (32 bits). Supports a 7- or 32-bit sequence number, depending on the wayside. |
| Message Time | Time defined by the sender's application layer. |
| Variable Header Size | Per AAR S-9354 Edge Message Protocol Specification. |
| Time to Live | |
| Routing QoS | |
| Source | Lower case alphanumeric characters. |
| Destination | Lower case alphanumeric characters. |
| Message Body | Application payload data to be delivered |
| Data Integrity | Application Specific. A 32-bit value obtained by truncating a 160-bit value calculated using |
| Fixed and variable header data | Message Body Data Integrity |

TABLE 3

| Message Field Types | |
|---|---|
| Message Field Type | Formatting Notes |
| Alphanumeric | Fixed length, non-terminated string unless otherwise indicated in message definition<br>Printable unsigned ASCII character codes including blanks (0x20) in either UPPER or lower case<br>Left-justified and padded with trailing blanks, unless otherwise indicated in the message definition.<br>Converted to UPPER CASE by the receiver unless otherwise specified in the message definition. |
| Numeric String | Fixed length, non-terminated string unless otherwise indicated in message definition<br>ASCII characters "0"-"9", "+", and<br>Right-justified and padded with leading zeros |
| Binary | As described in message field definition. All binary message fields are encoded in the order of Most- Significant Bit (MSB) to Least-Significant Bit (LSB), unless otherwise specified in the message field definition. |
| Unsigned Integer | Unsigned integer of length specified<br>All multi-byte message fields are encoded in big-endian format. |

TABLE 4

| WDC Status Message Format | | |
|---|---|---|
| EMP Field | Value | Description |
| Protocol Version | 4 | |
| Message Type | 7120 | (legacy ref: ATCS label 0x128B) |
| Message Version | 0 | |
| Flags | | |
| Timestamp format | 1 | Absolute time |
| Encryption | 0 | Not encrypted |
| Compression | 0 | No compression in the message body. |

TABLE 4-continued

| WDC Status Message Format | | |
|---|---|---|
| EMP Field | Value | Description |
| Data Integrality | 1, 2 | 1 CRC, 2 HMAC |
| Data Length | | Per AAR S-9354 Edge Message Protocol Specification |
| Message Number | | Mod 128, The same as the ATCS header sequence number or 32 bit value. |
| Message Time | EMP Timestamp | |
| Variable header Size | | Per AAR S-9354 Edge Message Protocol Specification |
| Time To Live | 12 | Configurable per installation and message. Default value shown. |
| QoS | | |
| Class | 0 | Configurable per installation and message. Default value shown. |
| Priority | 6 | Configurable per installation and message. Default value shown. |
| Network Preference | 0 | Configurable per installation and message. Default value shown. |
| Special Handling | 0 | No SH |
| Service Requests | 0 | No requests |
| Source Address | | WDC Addressing |
| Destination Address | | OG Addressing |
| EMP Message Body | | Message body details |
| Data Integrity | CRC, HMAC value | |

TABLE 5

| WDC Status Message Body Format | | |
|---|---|---|
| Field name | Value | Description |
| Codeline Source Format (SF) | 0 . . . 2 | (8 bits) Format of indication bytes to follow:<br>SF = 0: Fully qualified codeline control bit format.<br>SF = 1: Octet Index partial format (ref: RCCI protocol partial format).<br>SF = 2: Bit Index Partial format (ref: MCS-2 protocol format). |
| Number of Indication Octets | 1-255 | (8 bits) Number of Octets in Codeline Indication Information field.<br>SF = 0: The number of fully qualified indication octets. |

TABLE 5-continued

| WDC Status Message Body Format | | |
|---|---|---|
| Field name | Value | Description |
| | | SF = 1: The total number of both index octets and indication octets. SF = 2: The total number of both index octets and indication octets. |
| Data bits in Last Octet | 1 . . . 8 | (8 bits) Number of control bits in last indication word octet. |
| Codeline Indication Information | 1-255 Octets | SF = 0: Fully qualified indication words of length defined in previous 2 fields. SF = 1: Octet pairs where first octet is octet index in fully qualified word, second octet is value of octet changed or to be changed (ref: RCCI protocol partial format). SF = 2: Octet pairs where first octet is bit index in fully qualified word, second octet is bit (set or reset) for octet changed or to be changed (ref: MCS-2 protocol format). |

TABLE 6

| WDC Status Ack Message Format | | |
|---|---|---|
| EMP Field | Value | Description |
| Protocol Version | 4 | |
| Message Type | 7121 | |
| Message Version | 0 | |
| Flags | | |
| Timestamp format | 1 | Absolute time |
| Encryption | 0 | Not encrypted |
| Compression | 0 | No compression in the message body. |
| Data Integrality | 1, 2 | 1 CRC, 2 HMAC |
| Data Length | | Per AAR S-9354 Edge Message Protocol Specification |
| Message Number | | The message number from the WDC Status Request for which this Acknowledgment was created. |
| Message Time | EMP Timestamp | |
| Variable header Size | | Per AAR S-9354 Edge Message Protocol Specification |
| Time To Live | 10 | Configurable per installation and message. Default value shown. |
| QoS | | |
| Class | 0 | Configurable per installation and message. Default value shown. |
| Priority | 6 | Configurable per installation and message. Default value shown. |
| Network Preference | 0 | Configurable per installation and message. Default value shown. |
| Special Handling | 0 | No SH |
| Service Requests | 0 | No requests |
| Source Address | | OG Addressing |
| Destination Address | | WDC Addressing |
| EMP Message Body | | The message body is empty. |
| Data Integrity | CRC, HMAC value | |

TABLE 7

| WDC Status Nack Message Format | | |
|---|---|---|
| EMP Field | Value | Description |
| Protocol Version | 4 | |
| Message Type | 7122 | |
| Message Version | 0 | |

TABLE 7-continued

| WDC Status Nack Message Format | | |
|---|---|---|
| EMP Field | Value | Description |
| Flags | | |
| Timestamp format | 1 | Absolute time |
| Encryption | 0 | Not encrypted |
| Compression | 0 | No compression in the message body. |
| Data Integrality | 1, 2 | 1 CRC, 2 HMAC |
| Data Length | | Per AAR S-9354 Edge Message Protocol Specification |
| Message Number | | The message number from the WDC Status for which this Nack was created. |
| Message Time | EMP Timestamp | |
| Variable header Size | | Per AAR S-9354 Edge Message Protocol Specification |
| Time To Live | 10 | Configurable per installation and message. Default value shown. |
| QoS | | |
| Class | 0 | Configurable per installation and message. Default value shown. |
| Priority | 6 | Configurable per installation and message. Default value shown. |
| Network Preference | 0 | Configurable per installation and message. Default value shown. |
| Special Handling | 0 | No SH |
| Service Requests | 0 | No requests |
| Source Address | | OG Addressing |
| Destination Address | | WDC Addressing |
| EMP Message Body | | The message body contains an 8 bit code indicating the reason for the Nack. |
| Data Integrity | CRC, HMAC value | |

TABLE 8

| WDC Status Nack Message Condition Codes | |
|---|---|
| Value | Description |
| 30 | OG session to Codeserver down<br>OG could not deliver message to codeserver/dispatch |
| 49 | Unspecified Code Server Delivery Error<br>OG encountered an unspecified issue while attempting delivery of the message to the Code Server |
| 81 | Invalid indication status word<br>OG rejected processing indication due to invalid indication word |
| 82 | Invalid indication status word length<br>OG rejected processing indication due to invalid indication word length |
| 83 | Invalid EMP CRC<br>OG rejected processing due to not passing the EMP CRC check |
| 84 | Invalid EMP HMAC<br>OG rejected processing due to not passing the EMP HMAC check |
| 85 | Invalid sequence number.<br>OG rejected processing due invalid sequence number |
| 98 | Unspecified Processing Failure<br>WDC or Code Server/Dispatch failed to successfully process the mesage |
| 99 | Unspecified Error<br>An unspecified error occurred in delivery or processing of the message |
| 128-254 | Railroad and/or Manufacture specific condition codes |

TABLE 9

| Get WDC Status Message Format | | |
|---|---|---|
| EMP Field | Value | Description |
| Protocol Version | 4 | |
| Message Type | 7123 | (legacy ref: ATCS label 0x1248 or 0x1249) |
| Message Version | 0 | |
| Flags | | |
| Timestamp format | 1 | Absolute time |
| Encryption | 0 | Not encrypted |
| Compression | 0 | No compression in the message body. |
| Data Integrality | 1, 2 | 1 CRC, 2 HMAC |
| Data Length | | Per AAR S-9354 Edge Message Protocol Specification |
| Message Number | | Mod 128, The same as the ATCS header sequence number or 32 bit value. See Section 1.5.2. |
| Message Time | EMP Timestamp | |
| Variable header Size | | Per AAR S-9354 Edge Message Protocol Specification |
| Time To Live | 15 | Configurable per installation and message. Default value shown. |
| QoS | | |
| Class | 0 | Configurable per installation and message. Default value shown. |
| Priority | 6 | Configurable per installation and message. Default value shown. |
| Network Preference | 0 | Configurable per installation and message. Default value shown. |
| Special Handling | 0 | No SH |
| Service Requests | 0 | No requests |
| Source Address | | OG Addressing |
| Destination Address | | WDC Addressing |
| EMP Message Body | | The message body is empty |
| Data Integrity | CRC, HMAC value | |

TABLE 10

| WDC Control Message Format | | |
|---|---|---|
| EMP Field | Value | Description |
| Protocol Version | 4 | |
| Message Type | 7124 | (legacy ref: ATCS label 0x1201) |
| Message Version | 0 | |
| Flags | | |
| Timestamp format | 1 | Absolute time |
| Encryption | 0 | Not encrypted |
| Compression | 0 | No compression in the message body. |
| Data Integrality | 1, 2 | 1 CRC, 2 HMAC |
| Data Length | | Per AAR S-9354 Edge Message Protocol Specification |
| Message Number | | Mod 128, The same as the ATCS header sequence number or 32 bit value. |
| Message Time | EMP Timestamp | |
| Variable header Size | | Per AAR S-9354 Edge Message Protocol Specification |
| Time To Live | 15 | Configurable per installation and message. Default value shown. |
| QoS | | |
| Class | 0 | Configurable per installation and message. Default value shown. |
| Priority | 6 | Configurable per installation and message. Default value shown. |
| Network Preference | 0 | Configurable per installation and message. Default value shown. |
| Special Handling | 0 | No SH |

TABLE 10-continued

| WDC Control Message Format | | |
|---|---|---|
| EMP Field | Value | Description |
| Service Requests | 0 | No requests |
| Source Address | | OG Addressing |
| Destination Address | | WDC Addressing |
| EMP Message Body | | Message body details. |
| Data Integrity | CRC, HMAC value | |

TABLE 11

| WDC Control Message Body Format | | |
|---|---|---|
| Field name | Value*** | Description |
| Codeline Source Format (SF) | 0 . . . 2 | (8 bits) Format of indication bytes to follow: SF = 0: Fully qualified codeline control bit format. SF = 1: Octet Index partial format (ref: RCCI protocol partial format). SF = 2: Bit Index Partial format (ref: MCS-2 protocol format). |
| Number of Indication Octets | 1-255 | (8 bits) Number of Octets in Codeline Indication Information field. SF = 0: The number of fully qualified indication octets. SF = 1: The total number of both index octets and indication octets. SF = 2: The total number of both index octets and indication octets. |
| Data bits in Last Octet | 1 . . . 8 | (8 bits) Number of control bits in last indication word octet. |
| Codeline Indication Information | 1-255 Octets | SF = 0: Fully qualified indication words of length defined in previous 2 fields. SF = 1: Octet pairs where first octet is octet index in fully qualified word, second octet is value of octet changed or to be changed (ref: RCCI protocol partial format). SF = 2: Octet pairs where first octet is bit index in fully qualified word, second octet is bit (set or reset) for octet changed or to be changed (ref: MCS-2 protocol format). |

TABLE 12

| WDC Control Ack Message Format | | |
|---|---|---|
| EMP Field | Value | Description |
| Protocol Version | 4 | |
| Message Type | 7125 | |
| Message Version | 0 | |
| Flags | | |
| Timestamp format | 1 | Absolute time |
| Encryption | 0 | Not encrypted |
| Compression | 0 | No compression in the message body. |
| Data Integrality | 1, 2 | 1 CRC, 2 HMAC |
| Data Length | | Per AAR S-9354 Edge Message Protocol Specification |
| Message Number | | The message number from the WDC Status Request for which this Acknowledgment was created. See Section 1.5.2. |
| Message Time | EMP Timestamp | |
| Variable header Size | | Per AAR S-9354 Edge Message Protocol Specification |

TABLE 12-continued

| WDC Control Ack Message Format | | |
|---|---|---|
| EMP Field | Value | Description |
| Time To Live | 10 | Configurable per installation and message. Default value shown. |
| QoS | | |
| Class | 0 | Configurable per installation and message. Default value shown. |
| Priority | 6 | Configurable per installation and message. Default value shown. |
| Network Preference | 0 | Configurable per installation and message. Default value shown. |
| Special Handling | 0 | No SH |
| Service Requests | 0 | No requests |
| Source Address | | WDC Addressing |
| Destination Address | | OG Addressing |
| EMP Message Body | | The message body is empty |
| Data Integrity | CRC, HMAC value | |

TABLE 13

| WDC Control Nack Message Format | | |
|---|---|---|
| EMP Field | Value | Description |
| Protocol Version | 4 | |
| Message Type | 7126 | |
| Message Version | 0 | |
| Flags | | |
| Timestamp format | 1 | Absolute time |
| Encryption | 0 | Not encrypted |
| Compression | 0 | No compression in the message body. |
| Data Integrality | 1, 2 | 1 CRC, 2 HMAC |
| Data Length | | Per AAR S-9354 Edge Message Protocol Specification |
| Message Number | | The message number from the WDC Control Request for which this Nack was created. |
| Message Time | EMP Timestamp | |
| Variable header Size | | Per AAR S-9354 Edge Message Protocol Specification |
| Time To Live | 10 | Configurable per installation and message. Default value shown. |
| QoS | | |
| Class | 0 | Configurable per installation and message. Default value shown. |
| Priority | 6 | Configurable per installation and message. Default value shown. |
| Network Preference | 0 | Configurable per installation and message. Default value shown. |
| Special Handling | 0 | No SH |
| Service Requests | 0 | No requests |
| Source Address | | WDC Addressing |
| Destination Address | | OG Addressing |
| EMP Message Body | | The message body contains an 8 bit code indicating the reason for the Nack. |
| Data Integrity | CRC, HMAC value | |

TABLE 14

| WDC Control Nack Message Condition Codes | |
|---|---|
| Value | Description |
| 01 | FG link to WDC down<br>Link between FG and WDC down, cannot deliver |

TABLE 14-continued

| WDC Control Nack Message Condition Codes | |
|---|---|
| Value | Description |
| 02 | Failed due to link errors<br>FG received link errors (CRC, parity, framing, . . .) and could not confirm delivery to WDC |
| 03 | WDC rejected message from FG<br>WDC either rejected message directly or would not Ack with the link healthy |
| 29 | Unspecified WDC Delivery Error<br>FG encountered an unspecified issue while attempting delivery of the message to WDC |
| 51 | Invalid control word<br>WDC rejected processing due to invalid control word |
| 52 | Invalid control word length<br>WDC rejected processing due to invalid control word length |
| 53 | Invalid EMP CRC<br>WDC rejected processing due to not passing the EMP CRC check |
| 54 | Invalid EMP HMAC<br>WDC rejected processing due to not passing the EMP HMAC check |
| 55 | WDC Vital logic module failure<br>WDC could not process due to a failure in the vitality module (e.g. failed CRC) |
| 56 | WDC logic module restarting WDC logic module is rebooting |
| 84 | Invalid EMP HMAC<br>OG rejected processing due to not passing the EMP HMAC check |
| 85 | Invalid sequence number.<br>WDC or FG rejected processing due invalid sequence number |
| 98 | Unspecified Processing Failure<br>WDC or Code Server/Dispatch failed to successfully process the message |
| 99 | Unspecified Error<br>An unspecified error occurred in delivery or processing of the message |
| 128-254 | Railroad and/or Manufacture specific condition codes |

TABLE 15

| WDC Reset Sequence Number Message Format | | |
|---|---|---|
| EMP Field | Value | Description |
| Protocol Version | 4 | |
| Message Type | 7127 | (legacy ref: ATCS label 0xD506) |
| Message Version | 0 | |
| Flags | | |
| Timestamp format | 1 | Absolute time |
| Encryption | 0 | Not encrypted |
| Compression | 0 | No compression in the message body. |
| Data Integrality | 1, 2 | 1 CRC, 2 HMAC |
| Data Length | | Per AAR S-9354 Edge Message Protocol Specification |
| Message Number | | Mod 128, The same as the ATCS header sequence number. |
| Message Time | EMP Timestamp | |
| Variable header Size | | Per AAR S-9354 Edge Message Protocol Specification |
| Time To Live | 15 | Configurable per installation and message. Default value shown. |
| QoS | | |
| Class | 0 | Configurable per installation and message. Default value shown. |
| Priority | 6 | Configurable per installation and message. Default value shown. |
| Network Preference | 0 | Configurable per installation and message. Default value shown. |
| Special Handling | 0 | No SH |
| Service Requests | 0 | No requests |
| Source Address | | OG Addressing |

TABLE 15-continued

| WDC Reset Sequence Number Message Format | | |
|---|---|---|
| EMP Field | Value | Description |
| Destination Address | | WDC Addressing |
| EMP Message Body | | The message body is empty. |
| Data Integrity | CRC, HMAC value | |

TABLE 16

| WDC Reset Sequence Number Ack Message Format | | |
|---|---|---|
| EMP Field | Value | Description |
| Protocol Version | 4 | |
| Message Type | 7128 | (legacy ref: ATCS label 0xD507) |
| Message Version | 0 | |
| Flags | | |
| Timestamp format | 1 | Absolute time |
| Encryption | 0 | Not encrypted |
| Compression | 0 | No compression in the message body. |
| Data Integrality | 1, 2 | 1 CRC, 2 HMAC |
| Data Length | | Per AAR S-9354 Edge Message Protocol Specification |
| Message Number | | The message number from the WDC Reset Sequence Number message for which this Acknowledgment was created. |
| Message Time | EMP Timestamp | |
| Variable header Size | | Per AAR S-9354 Edge Message Protocol Specification |
| Time To Live | 10 | Configurable per installation and message. Default value shown. |
| QoS | | |
| Class | 0 | Configurable per installation and message. Default value shown. |
| Priority | 6 | Configurable per installation and message. Default value shown. |
| Network Preference | 0 | Configurable per installation and message. Default value shown. |
| Special Handling | 0 | No SH |
| Service Requests | 0 | No requests |
| Source Address | | WDC Addressing |
| Destination Address | | OG Addressing |
| EMP Message Body | | The message body is empty. |
| Data Integrity | CRC, HMAC value | |

TABLE 16-continued

| WDC Reset Sequence Number Ack Message Format | | |
|---|---|---|
| EMP Field | Value | Description |

TABLE 17

| EMP Header and QoS Settings | | | | | | | |
|---|---|---|---|---|---|---|---|
| Message ID | Message Name | EMP Data Integrity | Special Handling | Network Preference | Priority | Class | Time to Live |
| 7120 | WDC Status | 1, 2 | 0 | 0 | 6 | 0 | 15 |
| 7121 | WDC Status Acknowledgement | 1, 2 | 0 | 0 | 6 | 0 | 10 |
| 7122 | WDC Status Negative Acknowledgement | 1, 2 | 0 | 0 | 6 | 0 | 10 |
| 7123 | Get WDC Status | 1, 2 | 0 | 0 | 6 | 0 | 15 |
| 7124 | WDC Control | 1, 2 | 0 | 0 | 6 | 0 | 15 |
| 7125 | WDC Control Acknowledgement | 1, 2 | 0 | 0 | 6 | 0 | 10 |
| 7126 | WDC Control Negative Acknowledgement | 1, 2 | 0 | 0 | 6 | 0 | 10 |
| 7127 | WDC Reset Sequence Number | 1, 2 | 0 | 0 | 6 | 0 | 15 |
| 7128 | WDC Reset Sequence Number Acknowledgement | 1, 2 | 0 | 0 | 6 | 0 | 10 |

TABLE 18

| WIU Status Message Body Format | | |
|---|---|---|
| Field name | Value | Description |
| WIU Address | 7RRRLLLGGGSS | (40 bits numeric) ATCS type address. |
| Beacon TTL | 0 . . . 1 | (1 bit) Beacon expiration indicates whether the beacon will or will not expire. |
| Vital Message Type | | (6 bits) Defined by WIU. |
| Vital Message Version | | (5 bits) |
| Mod 16 Time | | (4 bits) Low order 4 bits of timestamp. |
| Message Sequence Number | 0 . . . 255 | (8 bits) |
| Device Status | | (1-1944 bits) Device status generated by WIU. WIU Device Status with WDC fully qualified indication words appended on to the end. |
| VDIV | (HMAC) | (32 bits) HMAC vital data integrity value generated by WIU (same format as EMP HMAC but a separate field from the EMP HMAC only calculated across this message body). |

TABLE 19

Common ISMP Data Dictionary Variables

| Variable Name | Variable ID | Data Type | Variable Description |
|---|---|---|---|
| Initialization Time | 0000 | Integer (Unix time) | Time at which the process was initialized (which process is dependent on the defined default or the context of the event). |
| Hardware Type | 0011 | ASCII (String) | Indicates the type of hardware (e.g. Locomotive Radio). |
| Hardware Vendor | 0012 | ASCII (String) | Vendor |
| Hardware Model | 0013 | ASCII (String) | Model |
| Hardware Version | 0014 | ASCII (String) | Version |
| Hardware Version Date | 0015 | ASCII (String) | Version date |
| Hardware Serial Number | 0016 | ASCII (String) | Serial number |
| Hardware Manufacturer | 0017 | ASCII (String) | Manufacturer |
| Software Type | 0018 | ASCII (String) | Indicates the type of software (e.g. OS, application or utility), set depending on the context of the event. |
| Software Vendor | 0019 | ASCII (String) | Vendor |
| Software Model | 0020 | ASCII (String) | Model (e.g. workstation, server or professional) |
| Software Version | 0021 | ASCII (String) | Version |
| Software Version Date | 0022 | ASCII (String) | Version date |
| Software Install Date | 0023 | ASCII (String) | Install date |
| Software Serial Number | 0024 | ASCII (String) | Serial number |
| Software Manufacturer | 0025 | ASCII (String) | Manufacturer |
| Uptime | 0031 | Integer (Minutes) | The uptime in minutes of the operating environment or application. |

TABLE 20

WDC/FG Specific Data Dictionary Variables

| Variable Name | Variable ID | Data Type | Variable Description |
|---|---|---|---|
| Total EMP Messages Received | 8192 | Integer (Count) | Count of total EMP messages received since the last reset of the variable. |
| Last EMP Message Received Time | 8193 | Integer (Unix Time) | Time when the last EMP message was received (not counting current request if applicable) |
| Total EMP Messages Sent | 8194 | Integer (Count) | Count of total EMP messages sent since the last reset of the variable. |
| Last EMP Message Sent Time | 8195 | Integer (Unix Time) | Time when the last EMP message was sent. |
| Total EMP Protocol Errors | 8196 | Integer (Count) | Total number of EMP messages that failed due to EMP protocol errors since the last reset of the variable. |
| Total EMP Data Integrity Errors | 8197 | Integer (Count) | Total number of EMP messages that failed due to EMP CRC data integrity errors since the last reset of the variable. |
| Total EMP Other Errors | 8198 | Integer (Count) | Count of total EMP errors other than protocol and data integrity errors. |
| EMP Statistics Reset Time | 8199 | Integer (Unix Time) | Time of last asset statistics reset |
| Battery Voltage | 8203 | ASCII (String) | Voltage and ID for each of the monitored battery banks (VDC). (ID, Voltage) |
| Utility Power | 8204 | Integer (Boolean) | Power on/off (0 = Off, 1 = On) |
| Temperature | 8205 | Integer (Temp) | Current temperature of the wayside enclosure (Degrees F.) |
| Enclosure door State | 8206 | Integer (Boolean) | State of the wayside enclosure door (0 = Closed, 1 = Open) |
| WDC Reboot | 8215 | Integer (Unix Time) | Last WDC reboot |
| Device Type | 8216 | ASCII (String) | Type of device that is processing the CTC requests in the field (WDC or FG) |
| FG Connectivity to WDC | 8217 | ASCII (String) | ID and current status of each individual I/O on WIU (ID, Status). |

TABLE 20-continued

| WDC/FG Specific Data Dictionary Variables | | | |
|---|---|---|---|
| Variable Name | Variable ID | Data Type | Variable Description |
| FG to WDC Protocol Type | 8218 | ASCII (String) | Type of legacy protocol used between the FG and the WDC. |
| Current WDC Vital Software Checksum | 8221 | Integer (Checksum) | The current vital software version checksum |
| Current WDC Vital Software CRC | 8222 | Integer (CRC) | The current vital software version CRC |
| Previous WDC Vital Software Checksum | 8223 | Integer (Checksum) | The vital software version checksum from before the most recent checksum |
| Previous WDC Vital Software CRC | 8224 | Integer (CRC) | The vital software version CRC from before the most recent CRC |
| WDC Software Health | 8225 | ASCII (String) | Health status of WDC software (Software ID, Value) |
| WDC Memory Health | 8226 | ASCII (String) | Health status of the WDC memory |
| WDC Hardware Health | 8227 | ASCII (String) | Health status of the WDC hardware |

TABLE 21

| WDC Failures, WDC-FG Link Failures, WDC-ITCM Link Failures, WDC-WIU Link Failures | |
|---|---|
| Message Name | Impact |
| WDC Status | Status changes will not be communicated to the FG or OG. The WDC Status will therefore not be received in the office. In the office, a timer would eventually expire (configurable time since last status received) and a Get WDC Status would be attempted and would fail (a configurable number of times). The office would then take appropriate action to notify of and remedy the failure. |
| WDC Status Acknowledgement | The Ack is in response to a status change. If the status was delivered to the office prior to a failure, the Ack from the office would not be received. The system would be in a valid state until the office timer expired when no additional statuses were received. |
| WDC Status Negative Acknowledgement | The Nack is in response to a status change. If the status was delivered to the office prior to a failure, the Nack from the office would not be received. Because of the failure, there would be no retry of the WDC Status. The office would either take action to notify of and remedy the failure as a result of the Nack condition code or as a result of subsequent statuses not being received. |
| WDC Status via WIU Status | The WIU would not receive an updated WDC Status. After the previous WDC Status was expired (configurable timer), the WIU would remove the additional CTC information from the WIU Status message and return it to its original format.<br>The office would interpret the missing CTC data to mean an unknown state for those indications and after a configurable period of time would take action to notify of and remedy the failure. |
| Get WDC Status | The WDC will not be able to respond to the request for status. If there is an FG, then the FG will indicate in a Nack that the WDC is unresponsive (possibly codes 01, 02, 29, or 99) and the office will take action to notify of and remedy the failure. If there is no FG, then the office will timeout waiting for a response (configurable timer) and will retry a configurable number of times prior to taking action to notify of and remedy the failure. |
| WDC Control | The WDC will not be able to respond to the control request. If there is an FG, then the FG will indicate in a Nack that the WDC is unresponsive (possibly codes 01, 02, 29, or 99) and the office will take action to notify of and remedy the failure. If there is no FG, then the office will timeout waiting for a response (configurable timer) and will retry a configurable number of times prior to taking action to notify of and remedy the failure. |
| WDC Control Acknowledgement | The Ack may be returned by the FG if the failure of the WDC cannot be detected until the command is executed. |
| WDC Control Negative Acknowledgement | The Nack may be returned by the FG if the failure of the WDC is detected in the validation of the request. |
| WDC Reset Sequence Number | If there is an FG, then this message would be consumed by the FG. If there is no FG, then there would be no response to this request from the WDC. The office would timeout after a configurable number of retries and then would take action to notify of and remedy the failure. |

TABLE 21-continued

| WDC Failures, WDC-FG Link Failures, WDC-ITCM Link Failures, WDC-WIU Link Failures | |
|---|---|
| WDC Reset Sequence Number Acknowledgement | This response will be returned by the FG regardless of the status of the WIU. |
| ISMP Solicited Status | This message will be received by the FG. The status values returned by the FG will reflect the status of the FG; however those status variables that the WDC is responsible will not be available or will have values indicating an unknown or failed state. The office will take appropriate action to notify and remedy the failure. |
| ISMP Ping | This message has two variations. The ping to the agent should be received by the FG and returned correctly. The ping to the asset will fail as the WDC is not available. The office will take appropriate action to notify and remedy the failure when the timeout expires. |
| ISMP Retrieve Logs | This message will retrieve the logs of the FG successfully. |

| Message Name | impact |
|---|---|
| WDC Status | Status changes will not be communicated to the OG. The WDC Status will therefore not be received in the office. In the office, a timer would eventually expire (configurable time since last status received) and a Get WDC Status would be attempted and would fail (a configurable number of times). The office would then take appropriate action to notify of and remedy the failure. |
| WDC Status Acknowledgement | The Ack is in response to a status change. If the status was delivered to the office prior to a failure, the Ack from the office would not be received. The FG would timeout waiting for the response and initiate appropriate retries of the WDC Status message. |
| WDC Status Negative Acknowledgement | The Nack is in response to a status change. If the status was delivered to the office prior to a failure, the Nack from the office would not be received. The FG would timeout waiting for the response and initiate appropriate retries of the WDC Status message. |
| WDC Status via WIU Status | The OG would not receive an updated WDC Status. The WDC Status will therefore not be received in the office. In the office, a timer would eventually expire (configurable time since last status received) and a Get WDC Status would be attempted and would fail (a configurable number of times). The office would then take appropriate action to notify of and remedy the failure. |
| Get WDC Status | The WDC will not be able to respond to the request for status. The office will timeout waiting for a response (configurable timer) and will retry a configurable number of times prior to taking action to notify of and remedy the failure. |
| WDC Control | The WDC will not be able to respond to the control request. The office will timeout waiting for a response (configurable timer) and will re-try a configurable number of times prior to taking action to notify of and remedy the failure. |
| WDC Control Acknowledgement | The Ack may be returned by the FG but would not be delivered to the office. The office will timeout waiting for a response (configurable timer) and will re-try a configurable number of times prior to taking action to notify of and remedy the failure. |
| WDC Control Negative Acknowledgement | The Nack may be returned by the FG but would not be delivered to the office. The office will timeout waiting for a response (configurable timer) and will re-try a configurable number of times prior to taking action to notify of and remedy the failure. |
| WDC Reset Sequence Number | The FG will not be able to respond to the request. The office will timeout waiting for a response (configurable timer) and will re-try a configurable number of times prior to taking action to notify of and remedy the failure. |
| WDC Reset Sequence Number Acknowledgement | The response will not be delivered to the office. The office will timeout waiting for a response (configurable timer) and will re-try a configurable number of times prior to taking action to notify of and remedy the failure. |
| ISMP Solicited Status | The WDC/FG will not be able to respond to the request. The office will timeout waiting for a response. The office will take appropriate action to notify and remedy the failure when the timeout expires. |
| ISMP Ping | The WDC/FG will not be able to respond to the request. The office will timeout waiting for a response. The office will take appropriate action to notify and remedy the failure when the timeout expires. |
| ISMP Retrieve Logs | The FG will not be able to respond to the request. The office will timeout waiting for a response. The office will take appropriate action to notify and remedy the failure when the timeout expires. |

What is claimed is:

1. A method for transmitting application level messages across railroad communication system comprising:

generating a message with an application having a format defined by a protocol;

generating a packet, generating the packet comprising encapsulating the message with a railroad edge messaging protocol (EMP) header and a railroad Class D messaging transport header to generate a packet; and transmitting the packet across a railroad communications system.

2. The method of claim 1, wherein the message comprises a railroad application message.

3. The method of claim 1, wherein the message comprises a systems management message has a format defined by the Interoperable System Management Protocol.

4. The method of claim 1, wherein generating the packet further comprises encapsulating the message in a Transport Control Protocol (TCP) header and an Internet Protocol (IP) header.

5. A method for exchanging railroad application messages, the method comprising:

generating a railroad application message;

encapsulating the railroad application message by processing through a railroad Edge Messaging Protocol (EMP) layer, a Class D railroad messaging layer, a Transport Control Protocol layer, and an Internet Protocol layer; and transmitting the encapsulated railroad application message through a communications segment to a destination.

6. The method of claim 5, wherein transmitting the encapsulated railroad application message through a communications segment comprises transmitting the encapsulated railroad application message through a segment of an Interoperable Train Control Communications (ITCC) system supporting an Interoperable Train Control Systems Management (ITCSM).

7. The method of claim 5, wherein transmitting the encapsulated railroad application message through a communications segment comprises transmitting the encapsulated railroad application message through a wireless link.

8. The method of claim 5, wherein the railroad application message comprises an unsolicited status message generated by a railroad field system in response to a change in a state of a railroad field system.

9. The method of claim 5, wherein the railroad application message comprises a request for a railroad field system status generated by a railroad back office system.

10. The method of claim 5, wherein the railroad application message comprises a control message generated by a railroad back office system for changing a state of a railroad field system.

11. The method of claim 5, wherein the railroad application message comprises a reset sequence message generated by a railroad back office system for resetting a message sequence number for subsequent messages generated by a railroad field system.

12. The method of claim 5, wherein the railroad application message comprises a selected one of an acknowledgement message and a negative acknowledgement message generated by the destination.

13. The method of claim 5, further comprising:

generating a System Management System (SMS) message using an Interoperable System Management Protocol (ISMP) at a selected one of the of the railroad back office system and the railroad field system;

encapsulating the SMS message by processing through a railroad Edge Messaging Protocol (EMP) layer, a Class D railroad messaging layer, a Transport Control Protocol layer, and an Internet Protocol layer; and transmitting the encapsulated SMS message through a communications segment and a systems management gateway to a railroad back office system or a railroad field system.

14. The method of claim 13, wherein transmitting the encapsulated SMS message through a communications segment and a systems management gateway comprises transmitting the encapsulated SMS message through a systems management gateway supporting an Interoperable Train Control Systems Management (ITCSM).

15. The method of claim 13, wherein the SMS message is generated by the railroad back office system and transmitted to the railroad field system and is selected from the group consisting of a status request, a ping request and a parse log request.

16. The method of claim 13, wherein the SMS message is generated by the railroad field system and transmitted to the railroad back office system and is selected from the group consisting of a status response, a ping response, and a parse log response.

17. The method of claim 5, further comprising:

receiving wayside status information from a wayside interface unit;

encapsulating with the wayside device controller the wayside status information through a railroad Edge Messaging Protocol (EMP) layer, a Class D railroad messaging layer, a Transport Control Protocol layer, and an Internet Protocol layer; and transmitting the encapsulated wayside status information to the railroad dispatch system through the communications segment.

18. The method of claim 5, wherein the destination comprises one of railroad back office system and a railroad field system.

19. A railroad control system comprising:

a communications system;

a railroad field system interfacing with the communications system through an application gateway;

a back office system interfacing with the communications system for exchanging messages with the railroad field system;

an application running in the back office system for generating messages for transmission to the railroad field system for monitoring and controlling the railroad field system, each application message associated with an Edge Messaging Protocol (EMP) header and a Class D header for transmission over the communications system.

20. The railroad control system of claim 19, wherein the application messages are selected from the group consisting of a request for railroad field system status, a control for changing a state of the railroad field system, and a reset sequence message generated for resetting a message sequence number for messages generated by the railroad field system.

21. The railroad control system of claim 19, further comprising another application running on the railroad field system for generating application messages for transmission to the back office system, the application associating each message with an EMP header and a Class D header for transmission over the communications system.

22. The railroad system of claim 19, wherein the back office is associated with a gateway for associating each message with an EMP header and a Class D header.

23. The railroad system of claim 19, wherein the railroad field system interfaces with the communications system through a field gateway.

24. The railroad system of claim 19, wherein the wayside device is further associated with a Wayside Interface Unit (WIU) providing WIU status messages and the application running on the wayside device controller is further operable to associate a WIU status message for transmission to the dispatch office system across the communications system.

25. The railroad system of claim 19, further comprising:

a System Management System (SMS) application running on the dispatch office system for processing SMS messages;

a systems management gateway for communicating SMS messages with the communications system;

a wayside messaging service interfacing the exchange of SMS messages between the wayside device controller and the communications system.

* * * * *